US010287656B2

(12) United States Patent
Kawashita et al.

(10) Patent No.: US 10,287,656 B2
(45) Date of Patent: May 14, 2019

(54) RARE EARTH MAGNET MOLDING AND METHOD FOR MANUFACTURING THE SAME

(75) Inventors: Yoshio Kawashita, Kamakura (JP); Kiyohiro Uramoto, Yokohama (JP); Takashi Miyamoto, Higashiyamato (JP); Yoshiteru Yasuda, Yokohama (JP)

(73) Assignee: NISSAN MOTOR CO., LTD., Yokohama-shi (JP)

( * ) Notice: Subject to any disclaimer, the term of this patent is extended or adjusted under 35 U.S.C. 154(b) by 1189 days.

(21) Appl. No.: 13/392,365

(22) PCT Filed: Aug. 4, 2010

(86) PCT No.: PCT/JP2010/063162
§ 371 (c)(1),
(2), (4) Date: Feb. 24, 2012

(87) PCT Pub. No.: WO2011/030635
PCT Pub. Date: Mar. 17, 2011

(65) Prior Publication Data

US 2012/0153759 A1 Jun. 21, 2012

(30) Foreign Application Priority Data

Sep. 9, 2009 (JP) ..... 2009-208621

(51) Int. Cl.
*H01F 7/02* (2006.01)
*B22F 1/00* (2006.01)
(Continued)

(52) U.S. Cl.
CPC ..... *C22C 28/00* (2013.01); *B22F 1/02* (2013.01); *B22F 3/14* (2013.01); *C22C 19/07* (2013.01);
(Continued)

(58) Field of Classification Search
CPC ..... H01F 1/057; H01F 1/0575
See application file for complete search history.

(56) References Cited

U.S. PATENT DOCUMENTS 4,762,574 A * 8/1988 Ghandehari ..... H01F 1/0577 148/103
6,814,776 B2 * 11/2004 Kanekiyo ..... B22F 3/225 148/101
(Continued)

FOREIGN PATENT DOCUMENTS

CN 1647218 A 7/2005
CN 101226799 A 7/2008
(Continued)

OTHER PUBLICATIONS

Machine translation of JP2006-310660A. Nov. 2006.*
(Continued)

*Primary Examiner* — Xiaowei Su
(74) *Attorney, Agent, or Firm* — Foley & Lardner LLP

(57) ABSTRACT

A rare earth magnet molding (1) of the present invention includes rare earth magnet particles (2), and an insulating phase (3) present among the rare earth magnet particles. Segregation regions (4) in which at least one element selected from the group consisting of Dy, Tb, Pr and Ho is segregated are distributed in the rare earth magnet particles (2). Accordingly, the rare earth magnet molding that has excellent resistance to heat in motor environments or the like while maintaining high magnetic characteristics (coercive force) is provided.

22 Claims, 5 Drawing Sheets

(51) Int. Cl.

| | |
|---|---|
| ***B22F 3/12*** | (2006.01) |
| ***C22C 28/00*** | (2006.01) |
| ***B22F 1/02*** | (2006.01) |
| ***B22F 3/14*** | (2006.01) |
| ***C22C 19/07*** | (2006.01) |
| ***C22C 38/00*** | (2006.01) |
| ***H01F 1/057*** | (2006.01) |
| ***H01F 41/02*** | (2006.01) |

(52) U.S. Cl.
CPC ..... *C22C 38/005* (2013.01); *H01F 1/0572* (2013.01); *H01F 1/0573* (2013.01); *H01F 41/0266* (2013.01); *H01F 41/0293* (2013.01); *H01F 1/0576* (2013.01); *H01F 1/0577* (2013.01)

(56) References Cited

U.S. PATENT DOCUMENTS

| | | | | |
|---|---|---|---|---|
| 7,608,153 | B2 | 10/2009 | Tayu et al. | |
| 7,927,501 | B2 | 4/2011 | Komuro et al. | |
| 2003/0189475 | A1* | 10/2003 | Blume | H01F 1/0558 335/302 |
| 2005/0133117 | A1* | 6/2005 | Tayu | H01F 1/0576 148/105 |
| 2005/0145301 | A1 | 7/2005 | Honkura | |
| 2006/0048855 | A1* | 3/2006 | Honkura | H01F 41/0293 148/105 |
| 2008/0054738 | A1* | 3/2008 | Komuro | B82Y 10/00 310/46 |
| 2008/0117008 | A1 | 5/2008 | Komuro et al. | |
| 2009/0322459 | A1* | 12/2009 | Nagata | C23C 14/18 335/302 |
| 2010/0003156 | A1* | 1/2010 | Suzuki | B22F 1/025 419/10 |

FOREIGN PATENT DOCUMENTS

| | | | | | |
|---|---|---|---|---|---|
| CN | 101320609 | A | * | 12/2008 | |
| EP | 1 494 251 | A1 | | 1/2005 | |
| JP | 03178102 | A | * | 8/1991 | |
| JP | 07074012 | A | * | 3/1995 | |
| JP | 2001-230107 | A | | 8/2001 | |
| JP | 2002-144328 | A | | 5/2002 | |
| JP | 2002302702 | A | * | 10/2002 | H01F 1/0571 |
| JP | 2005-183781 | A | | 7/2005 | |
| JP | 2006-310660 | A | | 11/2006 | |
| JP | WO 2008032667 | A1 | * | 3/2008 | C23C 14/18 |
| JP | 2008-130780 | A | | 6/2008 | |
| JP | 2009-49378 | A | | 3/2009 | |
| JP | 2010-206045 | A | | 9/2010 | |
| WO | WO 03/085684 | A1 | | 10/2003 | |

OTHER PUBLICATIONS

Machine translation of CN101320609 A, Dec. 2008.*
Machine translation of JP07-074012 A, Mar. 1995.*
Machine translation of JP03-178102 A, Aug. 1991.*
Machine translation of JP2009-049378A, Mar. 2009.*
Machine translation of JP2002-302702A, Oct. 2002.*
Japanese Office Action and English translation dated Dec. 10, 2013; (6 pgs.).
Chinese Office Action dated Jun. 4, 2014, 7 pgs.

* cited by examiner

RARE EARTH MAGNET MOLDING AND METHOD FOR MANUFACTURING THE SAME

TECHNICAL FIELD

The present invention relates to a magnet molding and a method for manufacturing the same. The magnet molding provided by the present invention is used in, for example, a motor.

BACKGROUND ART

With regard to a conventional magnet molding used for a motor or the like, a ferrite magnet that is a permanent magnet has been mainly used. However, in association with an increase in performance and decrease in size of a motor, usage of a rare earth magnet having more excellent magnetic characteristics has increased in recent years.

A rare earth magnet such as a Nd—Fe—B type magnet used for a motor or the like has a problem with low resistance to heat. In response to this problem, a method for covering magnet particles in a magnet with an insulating substance to three-dimensionally isolate flow paths of eddy current and decrease the amount of heat generation has been proposed. In addition, various technologies according to the type and production method of the insulating substance have been reported. Such technologies contribute to an increase in resistance to heat in motor environments by decreasing the amount of self-heat generation of a magnet in association with suppression of eddy current. However, there is a problem with those technologies that cannot sufficiently exert an improving effect on magnetic characteristics (coercive force) at high temperature with respect to external heating.

In response to such a problem, Patent Literature 1 suggests a magnet provided with an element involved in increasing magnetic characteristics (coercive force) at an interface between magnet particles and an insulating phase included in the magnet, and a method for manufacturing the same.

CITATION LIST

Patent Literature

Patent Literature 1: Japanese Patent Unexamined Publication No. 2009-049378

SUMMARY OF INVENTION

In order to meet increasing demands for low heat generation, it is necessary to improve an insulating property, and therefore, a thick insulating phase is required to be applied. On the other hand, it has become evident according to the studies of the inventors of the present invention that there is a problem with the magnetic characteristics that may be degraded because of an unavoidable chemical reaction between the insulating substance and the magnet particles if the insulating phase is simply thickened.

The inventors of the present invention found out that the problems described above would be solved by controlling particle diameters of the magnet particles. That is, when the content of the magnet particles having large particle diameters is increased, the area of the interface at which the chemical reaction is caused is decreased, and magnetic force of the magnet particles in the insulating phase is concurrently increased. As a result, degradation influence on the magnetic characteristics can relatively be reduced.

On the other hand, if the particle diameters of the magnet particles are excessively increased, a rate of inner defects that inhibit the magnetic characteristics of the magnet particles is increased, or variations in direction of crystal particles become large. As a result, even if the method described in Patent Literature 1 is used, the effect of the improved magnetic characteristics (coercive force) does not necessarily reach deep into the magnet particles, and the excellent magnetic characteristics may not be maintained.

The present invention has been made in view of such conventional problems. It is an object of the present invention to provide a magnet molding having excellent resistance to heat in motor environments or the like while maintaining high magnetic characteristics (coercive force).

A rare earth magnet molding according to a first aspect of the present invention includes: rare earth magnet particles; and an insulating phase present among the rare earth magnet particles. Segregation regions in which at least one element selected from the group consisting of Dy, Tb, Pr and Ho is segregated are distributed in the rare earth magnet particles.

A method for manufacturing a rare earth magnet molding according to a second aspect of the present invention includes the steps of: covering a surface of raw material magnetic powder with a single substance of at least one element selected from the group consisting of Dy, Tb, Pr and Ho or an alloy thereof to obtain surface-modified raw material magnetic powder; subjecting the obtained surface-modified raw material magnetic powder to pressure molding under a heating atmosphere while subjecting to magnetic orientation in a magnetic field to obtain an anisotropic rare earth magnet; covering surfaces of rare earth magnet particles obtained by pulverizing the obtained anisotropic rare earth magnet with an insulating phase to obtain a magnet molding precursor; and heating the obtained magnet molding precursor under pressure.

A method for manufacturing a rare earth magnet molding according to a third aspect of the present invention includes the steps of: subjecting mixed magnetic powder of first raw material magnetic powder and second raw material magnetic powder to pressure molding under a heating atmosphere while subjecting to magnetic orientation in a magnetic field to obtain an anisotropic rare earth magnet, the second raw material magnetic powder being obtained by substituting at least one element selected from the group consisting of Dy, Tb, Pr, and Ho for a part of an element of the first raw material magnetic powder; covering surfaces of rare earth magnet particles obtained by pulverizing the obtained anisotropic rare earth magnet with an insulating phase to obtain a magnet molding precursor; and heating the obtained magnet molding precursor under pressure.

DESCRIPTION OF EMBODIMENTS

Figure 1:
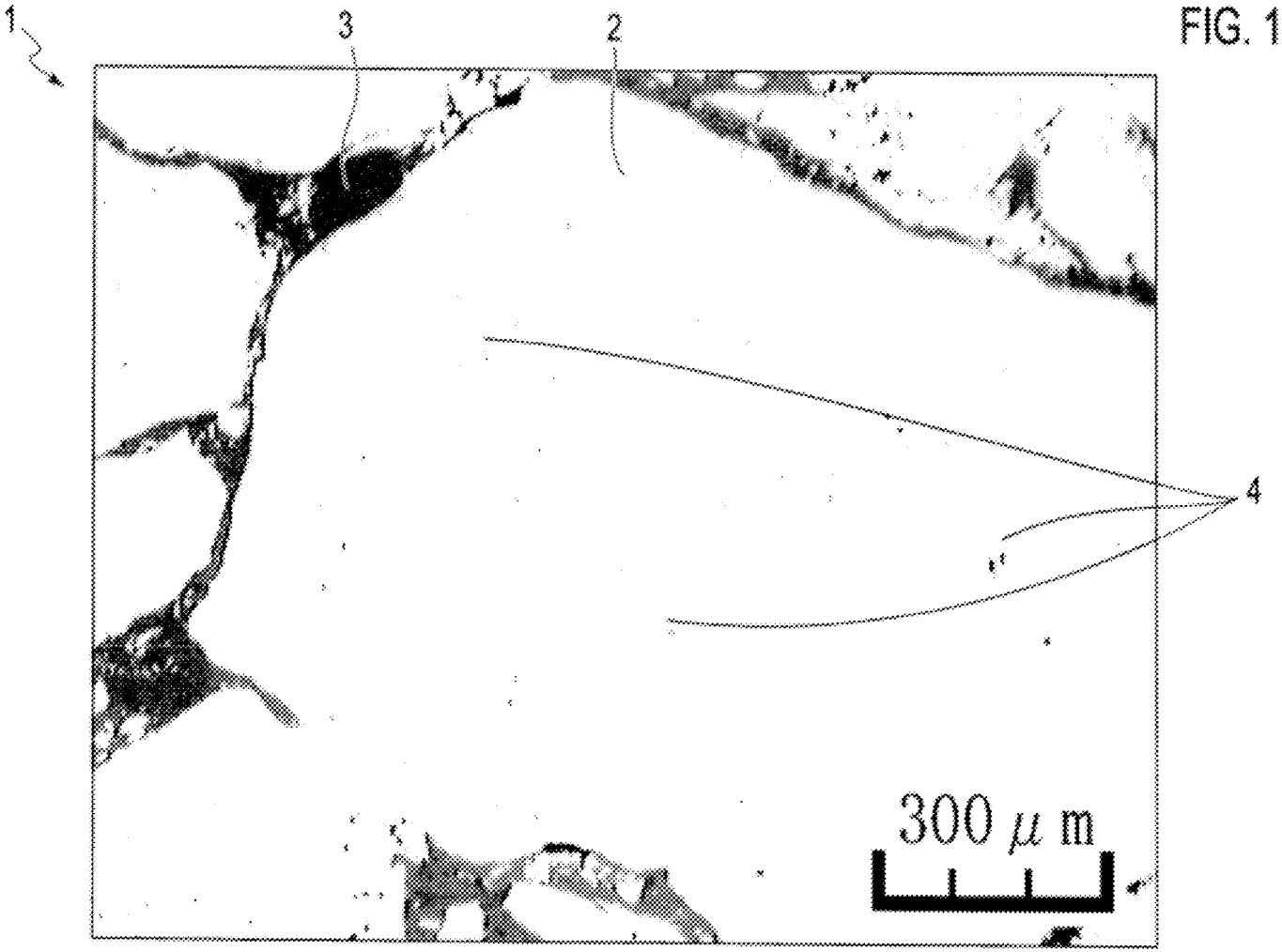
FIG. 1 is a cross-sectional photograph showing an example of a rare earth magnet molding according to an embodiment of the present embodiment.

A description will be made below in detail of an embodiment of the present invention with reference to the drawings. Note that, the dimensional ratios in the drawings are exaggerated for convenience of explanation, and may be different from the actual ratios.

[Rare Earth Magnet Molding]

A rare earth magnet molding according to the embodiment of the present invention includes magnet particles, and an insulating phase present among the magnet particles. In addition, the rare earth magnet molding includes segregation regions, in which at least one element selected from the group consisting of dysprosium (Dy), terbium (Tb), praseodymium (Pr) and holmium (Ho) is segregated, are distributed in the magnet particles.

FIG. 1 is a cross-sectional photograph of a rare earth magnet molding 1 according to the present embodiment. The rare earth magnet molding 1 includes rare earth magnet particles 2 that are magnet particles to exhibit magnetic characteristics, and an insulating phase 3. The insulating phase 3 is present among the rare earth magnet particles 2 so that the rare earth magnet particles 2 are bonded to each other via the insulating phase 3. In the rare earth magnet molding 1, segregation regions 4 in which a predetermined element is segregated are distributed in the rare earth magnet particles 2. The segregation regions 4 contain a segregation element. The "segregation element" used herein is an element of which an average concentration in the segregation regions 4 is significantly higher than that of the rare earth magnet particles 2. In the present invention, an average concentration of a certain element is determined to be "significantly high" when the average concentration is 3% or higher than that of the rare earth magnet particles 2. The average concentration of the constitution element can be measured by linear analysis (linear profile of the element) by means of instrumental measurement such as Auger electron spectroscopy (AES), an electron probe X-ray microanalyzer (EPMA), energy dispersive X-ray spectroscopy (EDX) and wavelength dispersive X-ray spectroscopy (WDS).

Examples of the element that is relatively segregated (increase in concentration) in the segregation regions in the present invention include dysprosium (Dy), terbium (Tb), praseodymium (Pr), holmium (Ho), neodymium (Nd) and cobalt Co). Meanwhile, a major example of the element in which the concentration is relatively decreased in the segregation regions is iron (Fe). Note that, the photograph shown in FIG. 1 is one example for ease of understanding, and the scope of the present invention is not limited to the magnet having the configuration (such as figure and size) shown in the figure.

The "magnet particles" represent powder of a magnet material. One example of the magnet particles is the rare earth magnet particles 2 as shown in FIG. 1. The magnet material included in the magnet particles may be a material in which loss of eddy current is originally small, such as a ferrite magnet. However, a rare earth magnet is a material that has excellent electrical conductivity and easily generates eddy current. Therefore, when the magnet molding is made of a rare earth magnet, the magnet molding can have both highly-efficient magnetic characteristics and low eddy current loss. The following is an explanation of the case in which the magnet particles included in the magnet molding are rare earth magnet particles.

The "rare earth magnet particles" are a kind of the magnet particles as described above, and one of the components included in the magnet molding as shown in FIG. 1. The rare earth magnet particles include a ferromagnetic main phase and other components. If the rare earth magnet is a Nd—Fe—B type magnet, then the main phase is a $Nd_2Fe_{14}B$ phase. From the viewpoint of enhancement of the magnetic characteristics, the rare earth magnet particles are preferably produced from magnetic powder for an anisotropic rare earth magnet prepared by means of an HDDR method (hydrogenation decomposition desorption recombination method) or a hot deformation process. In particular, the rare earth magnet particles prepared by means of the HDDR method have a low melting point, and therefore can be subjected to heat and pressure molding at lower temperature. As a result, a reaction rate between the insulating phase and the magnet particles can be reduced, and high electrical resistivity can be obtained. Accordingly, a rare earth magnet molding having a significantly low heat generation property can be provided. The rare earth magnet particles produced from the magnetic powder for the anisotropic rare earth magnet prepared by means of the HDDR method or the hot deformation process are formed into a cluster of numerous crystal grains. In this case, it is preferable that the crystal grains included in the rare earth magnet particles have an average grain size similar to a single-domain particle size in terms of enhancement in coercive force. In addition to the Nd—Fe—B type magnet, the rare earth magnet particles may be made of a Sm—Co type magnet. From the viewpoints of magnetic characteristics and manufacturing costs of the magnet molding to be obtained, the Nd—Fe—B type magnet is preferred. However, the magnet molding of the present embodiment is not limited to that made of the Nd—Fe—B type magnet. In some cases, the magnet molding may contain two or more types of magnetic substances having the same fundamental constituent in the magnet molding. For example, two or more types of the Nd—Fe—B type magnets having different composition ratios may be contained in the magnet molding, or the Sm—Co type magnet may be used.

Note that, the "Nd—Fe—B type magnet" in this specification encompasses the concept of a state in which part of Nd or Fe is substituted with another element. Nd may partially or entirely be substituted with Pr. In other words, the Nd—Fe—B type magnet may include a $Pr_xNd_{2-x}Fe_{14}B$ phase or a $Pr_2Fe_{14}B$ phase. Moreover, Nd may partially be substituted with another rare earth element such as Dy, Tb and Ho. Namely, the Nd—Fe—B type magnet may include a $Dy_xNd_{2-x}Fe_{14}B$ phase, a $Tb_xNd_{2-x}Fe_{14}B$ phase, a $Ho_xNd_{2-x}Fe_{14}B$ phase, a $(Dy_mTb_{1-m})_xNd_{2-x}Fe_{14}B$ phase, a $(Dy_mHo_{1-m})_xNd_{2-x}Fe_{14}B$ phase, or a $(Tb_mHo_{1-m})_xNd_{2-x}Fe_{14}B$ phase. Such substitution can be performed by adjusting a blending ratio of an element alloy. Due to such substitution, enhancement in coercive force of the Nd—Fe—B type magnet can be achieved. The amount of Nd subjected to substitution is preferably set in a range from 0.01 atom % to 50 atom % with respect to Nd. When the amount of Nd subjected to substitution is within such a range, a remanent flux density can be maintained at a high level while effects due to substitution are sufficiently obtained.

In addition, Fe may be substituted with another transition metal such as Co. Such substitution can raise a Curie temperature (TC) of the Nd—Fe—B type magnet and thereby expand the operating temperature range thereof. The amount of Fe subjected to substitution is preferably set in a range from 0.01 atom % to 30 atom % with respect to Fe. When the amount of Fe subjected to substitution is within such a range, the thermal properties are improved while effects due to substitution are sufficiently obtained.

Note that the magnet molding may include magnetic powder for a sintered magnet as the magnet particles in some cases. If such magnetic powder is used, the magnetic powder is required to have a predetermined size, and even a grain of the magnetic powder is required to have a magnetic behavior as a cluster of single-domain particle magnetic powder.

The average particle diameter of the rare earth magnet particles in the magnet molding of the present embodiment is preferably set in a range from 5 μm to 500 μm, more preferably 15 μm to 450 μm, still more preferably 20 μm to 400 μm. When the average particle diameter of the rare earth magnet particles is 5 μm or larger, an increase in specific surface area of the magnet is suppressed, and degradation of the magnetic characteristics of the magnet molding is prevented. In addition, when the average particle diameter is 500 μm or smaller, crushing of the magnet particles caused by pressure during the manufacturing process and a decrease in electric resistance in association therewith can be prevented. Moreover, for example, when an anisotropic magnet is manufactured using magnetic powder for an anisotropic rare earth magnet prepared by means of HDDR processing as a raw material, the orientation of the main phase (which is the $Nd_2Fe_{14}B$ phase in the Nd—Fe—B type magnet) in the rare earth magnet particles can readily be aligned. The particle diameters of the rare earth magnet particles are controlled by adjusting the particle size of the rare earth magnetic powder that is the raw material for the magnet. Note that the average particle diameter of the rare earth magnet particles can be calculated from an SEM image. In particular, the rare earth magnet particles are observed in 30 viewing fields at 50-fold magnification and at 500-fold magnification, respectively. Then, the average particle diameter is determined according to an average value of respective shortest diameters and longest diameters of arbitrary 300 or more particles excluding the particles of which the longest diameters are equivalent to 1 μm or smaller.

The "insulating phase" is also one of the components included in the rare earth magnet molding as shown in FIG. 1. The insulating phase contains an insulating material. For example, the insulating material is a rare earth oxide. According to such a configuration, the insulation property in the rare earth magnet can sufficiently be ensured. Accordingly, the rare earth magnet molding having high resistance can be obtained. The insulating material may be the rare earth oxide having the composition represented by the following formula (I).

[Chem. 1]

$$R_2O_3 \quad (I)$$

The rare earth oxide may be either amorphous or crystalline. In the formula (I), R represents a rare earth element. Specific examples of R include dysprosium (Dy), scandium (Sc), yttrium (Y), lanthanum (La), cerium (Ce), praseodymium (Pr), neodymium (Nd), promethium (Pm), samarium (Sm), europium (Eu), gadolinium (Gd), terbium (Tb), holmium (Ho), erbium (Er), thulium (Tm), ytterbium (Yb), and lutetium (Lu). Two or more rare earth oxides may be contained in the insulating phase. In particular, the insulating phase 3 preferably contains neodymium oxide, dysprosium oxide, terbium oxide, praseodymium oxide, or holmium oxide. According to such a configuration, oxidation of Nd contained in the magnet particles and, in some cases, also in magnet fine particles described below in the magnet molding 1 can be decreased. In addition, decomposition of the $Nd_2Fe_{14}B$ phase (atomic ratio) that is important for magnetic characteristics can be suppressed. As a result, the generation of an unnecessary soft magnetic phase such as Fe-rich phase and B-rich phase can be reduced. Accordingly, the magnet molding capable of maintaining high magnetic characteristics (coercive force) can be obtained. From the viewpoint of economic efficiency, the insulating phase 3 particularly preferably contains dysprosium oxide.

As described above, the type of the rare earth oxide is not particularly limited, and the rare earth oxide may be a mixture or a composite oxide as long as the rare earth oxide is an oxide of a rare earth element. In addition, the constituent of the insulating phase is not particularly limited as long as it includes an insulating substance. Examples of the constituent include a metal oxide, fluoride and glass, in addition to the rare earth oxide.

Even when the insulating phase contains the rare earth oxide, the presence of impurities, reaction products, unreacted residues or fine holes caused during the manufacturing process other than the rare earth oxide is inevitable. A smaller amount of these impurities is preferable from the viewpoints of electrical conductivity and magnetic characteristics. However, there is substantially no problem with the magnetic characteristics and electrical conductivity of the manufactured magnet if the content of the rare earth oxide in the insulating phase is 80% by volume or more, preferably 90% by volume or more.

The content of the insulating phase is not particularly limited, but is preferably 1% to 20%, more preferably 3% to 10% in terms of a volume ratio with respect to the entire magnet molding of the present embodiment. When the content of the insulating phase is 1% or more, a high insulation property in the magnet is ensured. Accordingly, the magnet molding having high resistance is provided. In addition, the content of the insulating phase is 20% or less, a decrease in magnetic characteristics in association with a relative decrease in content of the rare earth magnet particles can be prevented. Moreover, the magnet molding can realize higher magnetic characteristics compared with a so-called bond magnet that is a conventional magnet obtained by solidification of magnetic powder with resin.

It is preferable to determine the thickness of the insulating phase 3 in the rare earth magnet molding 1 based on a balance between the magnetic characteristics (coercive force) and the electrical resistivity value. The following is a specific explanation thereof.

The electric resistance necessary for the insulating phase 3 is only required to block the paths between the magnet particles and the magnet fine particles in such a manner that induced current in the magnet particles and the magnet fine particles derived from electromotive force generated by electromagnetic induction in the motor is circulated in these particles. Even if the particles are locally shorted because of a defect of a part of the insulating phase, the intensity of eddy current is proportional to the vertical cross-sectional area through which magnetic flux passes. Therefore, the local short circuit in the magnet molding hardly contributes to heat generation. Thus, the insulating phase 3 according to the present embodiment is not required to have a high insulating property equivalent to the value that an insulating phase containing a complete oxide is expected to have. When the insulating phase has relatively high electric resistance compared to the magnet particles and the magnet fine particles, the insulating phase can accomplish the desired purpose of the present invention and exert the desired effect sufficiently.

Next, the electrical resistivity value and the thickness necessary for the insulating phase 3 will be described. The electric resistance is the product of the electrical resistivity by the thickness of the insulating material. Therefore, the thickness of the material can be thinner as the electrical resistivity value becomes higher. In general, when an insulating phase in an oxidized state is used, an electrical resistivity value of the oxide contained in the insulating phase is more than ten digits higher than that of magnet particles of a rare earth magnet having similar characteristics to a metal material. Thus, the insulating phase 3 can exert a sufficient effect even when the thickness is several tens of nm order.

However, in the case of the insulating phase 3 obtained by thermal decomposition using an organic complex of a rare earth element as a raw material as described below, it is inevitable to contain impurities and residues. In other words, when the bonding state of the rare earth element is analyzed by means of XPS (X-ray photoelectron spectroscopy) or the like, the bond with carbon or hydrocarbon is confirmed among the bond with oxygen. In addition, compared with the completely oxidized state, a substantial decrease in electrical resistivity is caused. From the perspective of reducing the amount of heat generation, it is preferable to decrease the bond described above other than the oxide as much as possible.

Meanwhile, from the perspective of maintaining the magnetic characteristics of the magnet particles and the magnet fine particles described below, it is generally difficult to raise the thermal decomposition temperature to high temperature required to form a complete oxide in order to prevent phase transformation and particle growth that impair the magnetic characteristics. Thus, it is inevitable to contain impurities and residues in the insulating phase.

Even in such a case, when the insulating phase contains the insulating material, such as the rare earth oxide, as the main component having a high electrical resistivity value, and has a thickness of 50 nm or more, a deterioration in electric resistance can sufficiently be avoided. Moreover, when the insulating phase has a thickness of 100 nm or more, a deterioration in electric resistance can almost completely be avoided. The "main component" used herein is a component that has the highest content in the insulating phase in terms of a volume ratio, and preferably the content is 50% by volume or more. Even when the insulating material other than the rare earth oxide described above is used, the electrical resistivity is sufficiently larger than that of the magnet particles as in the case of the rare earth oxide. Therefore, the required thickness of the insulating layer may be the same as in the case of the rare earth magnet oxide.

However, when the insulating phase 3 is too thick, the volume fraction of the magnet particles is decreased. As a result, the magnetic characteristics are impaired. Consequently, the thickness is preferably a sufficiently small value with respect to a quite general average particle diameter of magnet particles for a raw material. In particular, the thickness of the insulating phase 3 is 20 μm or less, preferably 10 μm or less, more preferably 5 μm or less.

When the insulating phase described above is formed on the surfaces of the magnet particles having the structure in which the magnet fine particles are adsorbed to the surfaces thereof, the magnet fine particles may be enclosed in the insulating phase. In particular, each of the magnet fine particles or a cluster of the magnet fine particles is fixed to the surfaces of the magnet particles by penetration of the insulating phase that behaves as if it is an adhesive or a binder.

In such a case, when processing into the magnet molding and then observing the cross-section thereof, the magnet molding does not necessarily have an apparent layer structure including the layer of the magnet fine particles and the layer of the insulating phase, but the structure in which the magnet fine particles are enclosed in the insulating phase is observed. However, even if the magnet molding has such a structure, it is difficult for the magnet fine particles to be continuously short-circuited and behave as a conductor, and there is no particular problem with the magnet molding of the present embodiment.

In the rare earth magnet molding 1, when the insulating phase 3 is present among the rare earth magnet particles 2, electric resistance of the rare earth magnet molding 1 is significantly increased. Although the rare earth magnet particles 2 are preferably completely covered with the insulating phase 3, the rare earth magnet particles 2 are not necessarily covered with the insulating phase 3 completely as long as the effects of increasing electric resistance and suppressing eddy current can be exerted. In addition, the configuration of the insulating phase 3 may be in the form of a continuous wall to surround the rare earth magnet particles 2 as shown in the figure, or may be in the form of a series of particle clusters to isolate the rare earth magnet particles 2.

The rare earth magnet molding 1 of the present embodiment is characterized by the segregation regions 4 in which a predetermined element is segregated and that are discretely distributed in the rare earth magnet particles 2. The segregation regions 4 are also one of the components contained in the rare earth magnet molding shown in FIG. 1. As shown in FIG. 1, the segregation regions 4 are phases present in the rare earth magnet particles 2. The respective segregation regions 4 are preferably formed into a continuous region and dispersed in the rare earth magnet particles 2 as shown in FIG. 1.

The segregation regions 4 contain one or more elements selected from the group consisting of Dy, Tb, Pr and Ho. The segregation regions 4 particularly preferably contain Dy or Tb, and most preferably contain Dy. Due to such a configuration, a decrease in effect of adding Dy, Tb, Pr and Ho at the time of coarsening of the magnet particles is suppressed, which was difficult to avoid by conventional methods. As a result, the rare earth magnet molding having both the excellent magnetic characteristics (coercive force) and the low heat generation property due to high electrical resistivity can be obtained.

The segregation regions 4 may contain the other element. The other element that can be contained in the segregation regions 4 may be Co. When the segregation regions 4 contain Co, resistance to oxidation in the magnet molding is improved, and a deterioration caused by the added rare earth element is prevented. Accordingly, the rare earth magnet molding having more excellent magnetic characteristics can be obtained. In the case of containing Co, the segregation regions 4 preferably further contain Nd. When the segregation regions 4 further contain Nd in addition to Co, a melting point of the segregation regions 4 is lowered. As a result, the segregation regions 4 are easily fused with the magnet particles (raw material magnetic powder). Thus, the element group of Dy, Tb, Pr and Ho is effectively dispersed in the magnet particles. In addition, even if a defect such as cracks is present in the raw material magnetic powder, the effect of recovering the defect is exerted because penetration of the elements into the defect sites is easily performed. Therefore, a generation of cracking at the time of applying pressure is decreased and thus, the rare earth magnet molding having excellent magnetic characteristics (coercive force) and a significantly low heat generation property can be obtained. In addition, when a liquid phase is present at the time of heat and pressure molding, the effect of promoting an increase in density at low temperature and low pressure is also exerted.

The presence of the segregation regions 4 can be confirmed by the observation by means of a scanning electron microscope (SEM) or a transmission electron microscope (TEM).

The "concentration" of an element used in the present specification represents a content percentage (atom %) of the element in terms of atomic conversion in the phase in which the element is present. The "average concentration" in the rare earth magnet particles 2 represents an average value of the concentrations of the elements in the respective magnet particles contained in the magnet molding of the present embodiment. For example, the concentration of Nd in the $Nd_2Fe_{14}B$ phase that is a main phase of a common rare earth magnet is 2/(2+14+1)=11.8 atom %.

The content of the segregation regions 4 in the rare earth magnet particles 2 is not particularly limited. However, the ratio of the number of the rare earth magnet particles having the segregation regions therein is preferably 50% or more of the rare earth magnet particles having the particle diameters of 200 μm or larger. The ratio of the number of the rare earth magnet particles described above is more preferably 50% or more of the rare earth magnet particles having the particle diameters of 100 μm or larger, still more preferably 80% or more of the rare earth magnet particles having the particle diameters of 100 μm or larger.

In view of low heat generation, the magnet molding 1 described above may be any of an isotropic magnet made of isotropic magnetic powder, an isotropic magnet fabricated by subjecting anisotropic magnetic powder to random orientation, and an anisotropic magnet fabricated by orienting anisotropic magnetic powder in a certain direction. However, if a magnet having a high energy product such as a motor for a vehicle is required, then the anisotropic magnet, which is made of the anisotropic magnetic powder as the raw material and is subjected to orientation in a magnetic field, is preferred.

Figure 2:
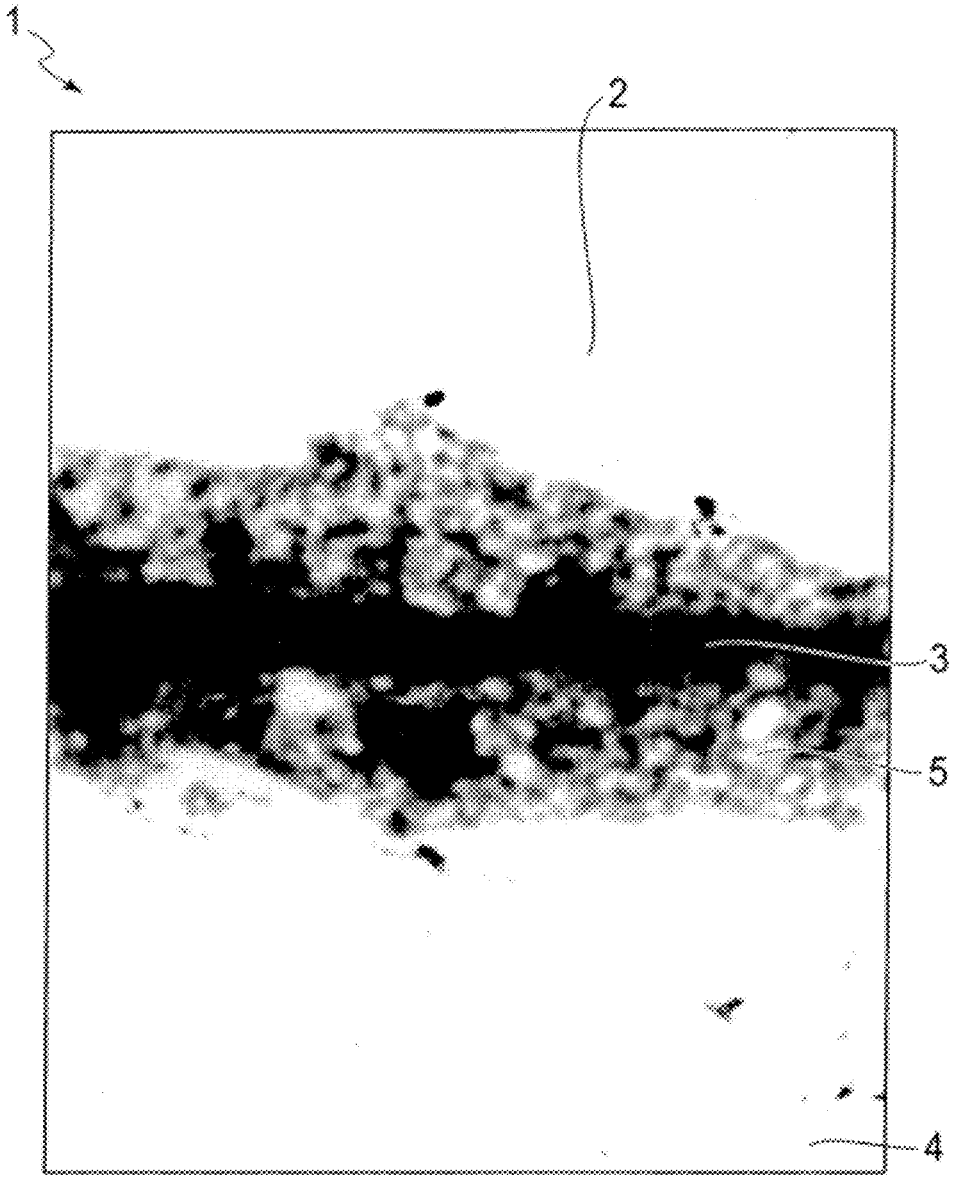
FIG. 2 is a cross-sectional photograph showing another example of the rare earth magnet molding according to the embodiment of the present embodiment.

FIG. 2 is a cross-sectional photograph of another example of the rare earth magnet molding of the present embodiment. As shown in FIG. 2, the magnet molding of this example includes aggregation regions 5 provided at the circumferences of the rare earth magnet particles 2, in which magnet fine particles are aggregated. The magnet fine particles included in the aggregation regions 5 have the same composition as the rare earth magnet particles 2, while the particle diameters are quite small. The particle diameters of the magnet fine particles are not particularly limited. However, the particle diameters of the magnet fine particles are required to be capable of spontaneous magnetization, and smaller values than the average particle diameter of the rare earth magnet particles 2. The average particle diameter of the magnet fine particles is preferably 30 μm or smaller, more preferably 25 μm or smaller. When the aggregation regions 5 are present as in this example, the magnet fine particles are adsorbed to the surfaces of the rare earth magnet particles 2 and as a result, the pointed magnet particles having protrusions are formed into a spherical shape. Thus, damage of the insulating phase 3 when processing into the magnet molding 1 is suppressed, and continuity of the insulating phase 3 is further improved. As a result, higher electrical resistivity can be obtained and therefore, the rare earth magnet molding 1 having a significantly low heat generation property can be provided. The lower limit of the average particle diameter of the magnet fine particles is not particularly limited, but may be 0.1 μm. The average particle diameter of the magnet fine particles may be measured in the same manner as the rare earth magnet particles.

In the case in which the aggregation regions 5 are present, the content of the aggregation regions 5 in the rare earth magnet molding 1 is not particularly limited. Although the preferable content of the aggregation regions 5 depends on the shape of the rare earth magnet particles, the mechanically-pulverized magnetic powder can sufficiently exert the effects described above when the proportion of the aggregation regions 5 is 5% or more of the rare earth magnet molding 1 in terms of a volume ratio.

Figure 3:
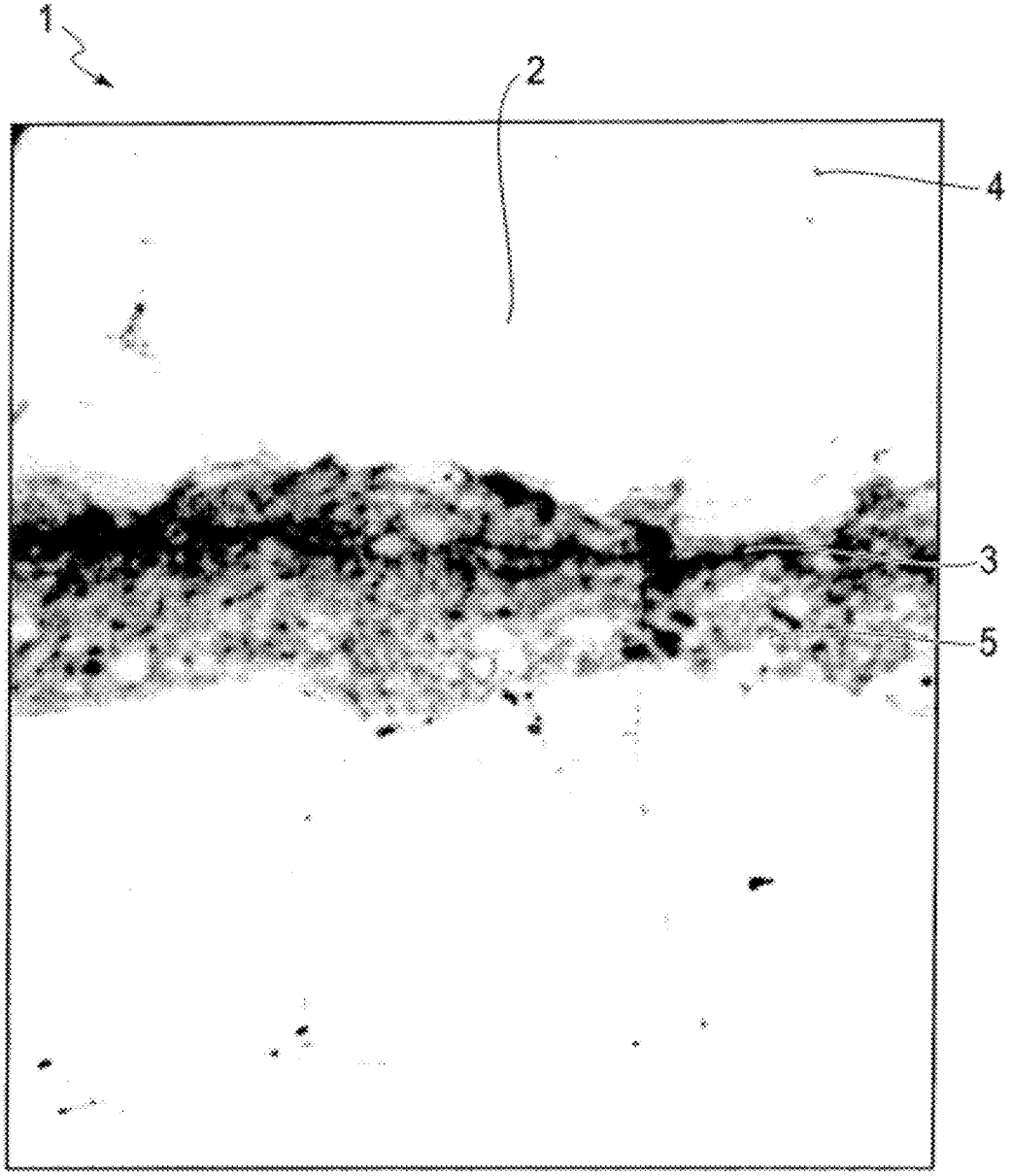
FIG. 3 is a cross-sectional photograph of the rare earth magnet molding in which a mixed region is present.

In addition, in the case in which the aggregation regions 5 are present, it is preferable to have the regions in which the magnet fine particles included in the aggregation regions 5 are mixed with the insulating phase 3. Due to such a configuration, high electrical resistivity can be maintained while the volume fractions of the insulating phase 3 and the aggregation regions 5 are decreased. Thus, the rare earth magnet molding having excellent magnet characteristics can be obtained. FIG. 3 shows a cross-sectional photograph of the rare earth magnet molding having such mixed regions. Whether "the regions in which the magnet fine particles included in the aggregation regions 5 are mixed with the insulating phase 3 are present" or not is determined by performing a texture observation at 200-fold magnification for arbitrary 150 or more magnet particles having short sides of 20 μm or longer. When the regions in which the boundaries between the magnet fine particles and the insulating phase located among the magnet particles are not clearly distinguishable account for 30% or more of the observed particles as a result of this observation, the configuration described above is determined to be fulfilled. FIG. 2 described above is the example in the case in which the mixed regions are not present while the aggregation regions 5 are present. Here, referring to FIG. 2 again, the boundaries between the insulating phase 3 and the regions (the aggregation regions 5) in which the magnet fine particles are sintered are clearly distinguishable. In other words, the sintered layers of the magnet fine particles and the insulating phase 3 constitute a continuous layer structure. Thus, the regions in which the boundaries between the magnet fine particles and the insulating phase are clearly distinguishable are regions in which the insulating phase is a continuous membrane having the thickness of at least 3 μm or more in cross-section. On the other hand, the mixed regions (that is, the regions in which the boundaries are not clearly distinguishable) are regions in which the insulating phase becomes thin because of penetration of the insulating phase into the magnet fine particle layer, and the insulating phase having the thickness of less than 3 μm is continuously or discontinuously present in the magnet fine particle layer.

[Method for Manufacturing Rare Earth Magnet Molding]

Next, a method for manufacturing the rare earth magnet molding will be explained. The method for manufacturing the rare earth magnet molding includes: a process (first process) of covering the surface of the raw material magnetic powder with a single substance of at least one element selected from the group consisting of Dy, Tb, Pr and Ho or an alloy thereof to obtain surface-modified raw material magnetic powder; and a process (second process) of subjecting the obtained surface-modified raw material magnetic powder to pressure molding under a heating atmosphere while subjecting to magnetic orientation in a magnetic field to obtain an anisotropic rare earth magnet. Further, the method includes: a process (third process) of covering the surfaces of the magnet particles obtained by pulverizing the obtained anisotropic rare earth magnet with the insulating phase to obtain a magnet molding precursor; and a process (fourth process) of heating the obtained magnet molding precursor under pressure.

According to such a manufacturing method, the element of Dy, Tb, Pr or Ho can effectively be dispersed even in the magnet particles 2 covered with the insulating phase 3. Thus, the rare earth magnet molding having high magnet characteristics (coercive force) is manufactured. Even when the raw material magnetic powder having a number of cracks present in the particles prepared by means of an HDDR method is used, the raw material magnetic powder is not easily damaged because of pressure bonding of the cracks. Accordingly, high electrical resistivity can be obtained and thus, the rare earth magnet molding having a significantly low heat generation property can be provided. Hereinafter, each process of the manufacturing method will be explained using one example of the rare earth magnetic powder as magnetic powder.

(First Process)

In the present process, the surface of the raw material magnetic powder is covered with a single substance of at least one element selected from the group consisting of Dy, Tb, Pr and Ho or an alloy thereof to obtain surface-modified raw material magnetic powder.

First, the raw material magnetic powder is prepared. The type of the raw material magnetic powder prepared is not particularly limited as long as the powder is raw material powder of a Nd—Fe—B type rare earth magnet. It is preferable to use magnetic powder having anisotropy such as sintered magnetic powder, magnetic powder prepared by an HDDR method, and magnetic powder prepared by an upset method because these have excellent magnetic characteristics. Note that one type of the raw material magnetic powder may be used singly, or a mixture of two or more types of the raw material magnetic powder may be used as in the case of Example 17 described below. In the case in which two or more types of the raw material magnetic powder are used, mixed magnetic powder of one magnetic powder (first raw material magnetic powder) and another magnetic powder (second raw material magnetic powder) obtained by substituting Dy, Tb, Pr, or Ho for a part of the element of the first raw material magnetic powder may be used. This method is a so-called binary alloy method. According to this method, the element of Dy, Tb, Pr or Ho can be dispersed in the magnet particles more simply and efficiently than the method of covering the surface of the raw material magnetic powder with the alloy containing the element of Dy, Tb, Pr or Ho.

However, if the size of the raw material magnetic powder becomes large, it is difficult to uniformly disperse the element in the magnet particles. In addition, if the raw material magnetic powder is too fine, the amount of the expensive element such as Dy and Tb is required to be relatively increased in order to improve coercive force. Further, when the surface of the fine raw material magnetic powder having the size of 10 μm or smaller, such as raw material magnetic powder for a sintered magnet, is covered with foreign substances, a significant deterioration in magnetic characteristics may be caused when the powder is processed into a bulk magnet because of insufficiency of a passivation effect on a particle interface.

Therefore, when the powder for a sintered magnet, which may includes the powder obtained by the binary alloy method, is used, a magnet once bulked as a common sintered magnet may be newly pulverized in a similar manner to the magnetic powder obtained by the HDDR method, and the powder having an average particle diameter of several hundreds of μm may be used as the raw material magnetic powder. This method has the advantage of being able to obtain a stable quality not depending on the type and size of the original raw material magnetic powder. That is, it is preferable to have three bulk processes in total for the raw material magnetic powder for a sintered magnet, and to have two bulk processes in total for the raw material magnetic powder for an HDDR magnet or upset magnet.

Next, the surface of the prepared raw material magnetic powder is covered with the single substance of the above-mentioned predetermined element or the alloy thereof in the present process. Thus, the surface-modified raw material magnetic powder is obtained.

Examples of the predetermined element include Dy, Tb, Pr and Ho. These elements have the effect of increasing crystal magnetic anisotropy and improving coercive force in the Nd—Fe—B type rare earth magnet. Further, Co may be added in addition to the predetermined element. Thus, the effect of increasing a Curie temperature can be obtained. In addition, the rare earth elements of Dy and Nd can lower a melting point of the magnet, and can perform the bulk process under the condition of lower temperature and reduced pressure. When the rare earth element of Nd, Dy, Tb, Pr or Ho and Co are added to the surface of the raw material magnetic powder concurrently or after alloying the rare earth element with Co, the activity of the rare earth element is decreased and oxidation is suppressed and therefore, operability of the magnetic powder is significantly improved. In addition, due to the lowered melting point, the effects of covering the surface of the magnetic powder evenly with the rare earth element and promoting densification of the surface of the magnetic powder can be obtained.

The method for covering the surface of the raw material magnetic powder with the predetermined element and the other element is not particularly limited. For example, a method for allowing preliminarily alloyed particles to adhere to the surface may be used, or a method for forming a film directly on the powder surface by means of a physical or chemical vapor deposition method. In the case of covering the surface with a single phase alloy having a low melting point, it is a simple way to perform chemical vapor deposition in a vacuum chamber.

(Second Process)

In the present process, the surface-modified raw material magnetic powder obtained in the first process is subjected to pressure molding under a heating atmosphere while being subjected to magnetic orientation in a magnetic field. As a result, an anisotropic rare earth magnet is obtained.

The surface-modified raw material magnetic powder is molded by means of a proper bulk process depending on the type of the raw material magnetic powder. When the magnetic powder for a sintered magnet is used as the raw material magnetic powder, the magnetic powder can be sintered by heating at a temperature as high as 1100° C. without applying pressure. In the case in which the other magnetic powder is used, it is difficult to heat the magnetic powder to a high temperature under the influence of a change in texture and a growth of the particles, and it is necessary to apply pressure.

With regard to the heat and pressure molding, discharge plasma sintering or hot pressing may be applicable. In particular, the surface-modified raw material magnetic powder is put in a metal mold and subjected to orientation treatment in a magnetic field described below, followed by heat and pressure molding at a high temperature of 550° C. or higher. The upper limit of the temperature depends on the component and type of the raw material magnetic powder. However, 800° C. or lower is preferable with regard to the raw material magnetic powder which is obtained by the HDDR method and the upset method and of which the magnetic characteristics may be deteriorated significantly because of a change in inside texture. On the other hand, the raw material magnetic powder such as a sintered magnet, which does not realize magnetic characteristics when the heating temperature is too low and is generally heated up to 1200° C. without applied pressure, can be heated up to approximately 1200° C. However, at such a high temperature, the raw material magnetic powder or the surface-modified raw material magnetic powder may be reacted with and burned into the molding die. Thus, it is necessary to use the molding die that has been subjected to special protection treatment such as coating, which results in a high cost. Therefore, it is preferable to subject the raw material magnetic powder to heat and pressure molding at 800° C. or lower. The pressure to be applied is preferably 50 MPa or higher. It is preferable to apply molding pressure as high as possible to the extent that the raw material magnetic powder is not burned into the molding die. The molding pressure is preferably 200 MPa or higher, more preferably 400 MPa or higher.

Before heating, the surface-modified raw material magnetic powder is required to be preliminarily subjected to orientation treatment in a magnetic field. When the magnetic powder having anisotropy is subjected to orientation treatment in a magnetic field, a magnetic direction is aligned. Thus, the anisotropic magnet molding having excellent magnetic characteristics can be obtained. Generally, the magnetic field for orientation to be applied is approximately from 1.2 to 2.2 MA/m, and the preforming pressure is approximately from 49 to 490 MPa. At the time of subjecting to magnetic field orientation, it is necessary to adjust the magnetic field for orientation depending on the size and material of the molding die in such a manner that the surface-modified raw material magnetic powder in the molding die rotates so that the easy axis of magnetization is oriented in the direction of the magnetic field.

When the raw material magnetic powder is once subjected to heat and pressure molding as in the case of the present process, pressure bonding of pores or cracks in the raw material magnetic powder seen in an HDDR magnet can be carried out. As a result, cracking of the magnet particles that may cause damage to the insulating phase is prevented. In particular, the HDDR magnet is raw material magnetic powder that is pulverized by use of a volume change by hydrogen storage and release treatment. Therefore, the inside cracks cause cracking of the magnet particles during the bulk process of the rare earth magnet molding, and also damage the insulating phase required for high resistivity. Thus, there was a problem with the HDDR magnetic powder that inhibited an increase in resistivity of the rare earth magnet molding. However, the manufacturing method of the present invention can greatly decrease cracking in the magnet particles and contribute to high resistivity.

There was also a problem with the sintered magnet that could not realize magnetic characteristics when applying the insulating phase directly to the raw material powder. Thus, a conventional method could not cover the raw material magnetic powder with the insulating phase for high resistivity. On the other hand, the manufacturing method of the present invention can process into the magnet particles having the size sufficient to maintain the magnetic characteristics even if the magnet particles are covered with the insulating phase.

(Third Process)

In the present process, the surfaces of the magnet particles obtained by pulverizing the anisotropic rare earth magnet obtained in the second process are covered with the insulating phase. As a result, a magnet molding precursor is obtained.

First, the anisotropic rare earth magnet obtained above is pulverized. Then, the pulverized magnet is classified by use of a sieve or the like as necessary. The specific method of pulverizing is not particularly limited, but the pulverization is preferably carried out in inert gas or vacuum. In addition, the particle size distribution of the magnet particles is not particularly limited, but can be arbitrarily adjusted to increase in bulk density. One of the characteristics of the present invention is that the coarse anisotropic magnet particles having excellent magnetic characteristics, which were difficult to obtain by a conventional method, can easily be obtained as described above.

Subsequently, the surfaces of the magnet particles thus obtained are covered with the insulating phase in the present process. Prior to this step, an additional step of mixing and integrating the magnet particles and the magnet fine particles may be carried out. When carrying out this step, the magnet particles obtained by the integration will be subjected to a covering process described below. Due to such an additional step, the magnet fine particles are adsorbed to the surfaces of the magnet particles and therefore, damage of the insulating phase during the heat and pressure molding can be suppressed. As a result, high electrical resistivity can be obtained and thus, the rare earth magnet molding having a significantly low heat generation property can be obtained. Here, the step of mixing and integrating the magnet particles and the magnet fine particles will be described in detail. This is a treatment for the deposition of the magnet fine particles on the circumferences of the magnet particles.

The type of the magnet fine particles used for the integration with the magnet particles are not particularly limited as long as the particles are raw material magnetic powder from the viewpoint of improving electrical resistivity. However, the magnet fine particles are preferably the same pulverized substance as the magnet particles because such a substance does not cause a deterioration of the magnet particles because of an unnecessary and disadvantageous chemical reaction. As a further explanation of the "same substance", the magnet particles and the magnet fine particles are preferably completely the same substance in view of economic efficiency and workability. More specifically, the magnet particles and the magnet fine particles preferably have the same composition because the magnet fine particles are immediately adsorbed to the magnet particles by being subjected to grinding such as ball milling, barrel grinding and jet milling to obtain the powder of the magnet particles formed into a spherical shape. Accordingly, an excellent manufacturing efficiency can be achieved.

Note that other component may be added to the magnet fine particles to the extent that a deterioration of the magnet particles because of an unnecessary and disadvantageous chemical reaction is hardly caused. The other component may be added to the magnet particles in order to, for example, adjust a softening point, generate a liquid phase, improve penetration of the liquid phase, enhance an anisotropic magnetic field, and increase the Curie point. A parameter controlled for the adjustment of the softening point is an amount of Nd. A parameter controlled for the improvement in penetration of the liquid phase is an amount of, for example, Dy and Nd. Examples of the element that improves penetration of the liquid phase include aluminum (Al), copper (Cu) and gallium (Ga). A component controlled for the enhancement of the anisotropic magnetic field is a component that aligns plural single-domain particles (domains) in approximately the same direction to improve the magnetic field. Specific examples of the component include Dy, Tb, Pr and Ho. A common element used for the increase in Curie point is Co.

In the rare earth magnet molding of the present embodiment, 60% by mass or more of the magnet fine particles preferably have the same composition with respect to 100% by mass of the magnet particles. The reason for "60% by mass or more", namely, the reason why 60% by mass or more of the magnet fine particles preferably have the same composition with respect to the magnet particles will be explained in more detail.

The compound phase generated by the addition of these elements relatively reduces the ratio of $Nd_2Fe_{14}B$ as the main phase, and loss of magnetization or maximum energy product is caused. Thus, an excessive addition of these elements may cause an unnecessary and disadvantageous deterioration.

Meanwhile, it is known that the addition of the element such as Dy and Tb is effective for the improvement in magnetic characteristics (coercive force). For example, as the binary alloy method in the sintered magnet, it is a known method that raw material magnetic powder having a low rare earth composition of which the main phase of $Nd_2Fe_{14}B$ is rich is mixed with raw material magnetic powder having a high rare earth composition that has a high Dy content and excessively contains the rare earth element such as Nd and Dy compared with a main phase stoichiometric composition. In addition, it is a known method that the surface of a rare earth magnet molding prepared from raw material magnetic powder having a low rare earth composition is subjected to grain boundary diffusion of Dy.

Similarly in the present embodiment, when the magnet fine particles excessively containing the rare earth element such as, especially Dy and Tb, compared with the magnet particles are used in order for the improvement in magnetic characteristics (coercive force), the effect of improving magnetic characteristics (coercive force) can be obtained as in the case of the magnet obtained by the binary alloy method and the grain boundary diffusion magnet. Moreover, when an alloy layer having a low melting point is formed in the insulating phase, cracking at the time of pressure molding in the bulk process can be decreased. Accordingly, the magnet molding further having excellent electrical resistivity can be obtained.

As described above, when a large amount of the magnetic powder excessively containing the rare earth element is used, the electrical resistivity, magnetic characteristics (coercive force) and resistance to heat are improved. On the other hand, the ratio of $Nd_2Fe_{14}B$ as the main phase is decreased, and the magnetization property and the maximum energy product are decreased as described above. In view of these aspects, the content of the magnet fine particles is preferably 40% by volume or less with respect to the magnet particles since an excessive decrease in magnetization and maximum energy product can be prevented.

In the present embodiment, when the average particle diameter of the magnet fine particles to be integrated with the magnet particles by allowing the magnet fine particles to be adsorbed to the surfaces thereof is too large compared with that of the magnet particles, the magnet particles are prevented from being formed into a spherical shape. Moreover, when not only the magnet fine particles but also the magnet particles as the raw material are subjected to magnetization, the magnet particles are mutually integrated (adsorbed). As a result, specified effects cannot be obtained. Therefore, it is preferable to cause the magnetized magnet fine particles to be adsorbed to the magnet particles as the raw material so as to be formed into a spherical shape. In addition, since the magnet fine particles behave as independent particles, it is preferable to have the average particle diameter of the magnet fine particles as small as possible to the extent that the magnet fine particles are capable of spontaneous magnetization in view of further enhancing the degree of integration.

More specifically, the average particle diameter of the magnet fine particles is preferably 1/10 or less, more preferably 1/20 or less with respect to the average particle diameter of the magnet particles. In order that the magnet particles are formed into a spherical shape, the magnet fine particles are required to be adsorbed to the magnet particles. When the average particle diameter of the magnet fine particles is too large, the magnet fine particles have a multi-domain structure. As a result, it is difficult for the magnet fine particles to be adsorbed to the magnet particles. In order that the magnet fine particles can exert the characteristics as a magnet and be adsorbed to the magnet particles without being subjected to external magnetizing treatment, the magnet fine particles preferably have the size sufficient to have a single-domain structure. Therefore, the average particle diameter of the magnet fine particles is preferably 30 μm or smaller, more preferably 20 μm or smaller.

Here, the correlation between the particle diameter and the magnetization will be explained in more detail. When the magnet fine particles have predetermined particle diameters or larger, the magnet fine particles are divided into several magnetic domains magnetized in different directions to have a multi-domain structure. As a result, the magnet fine particles as a whole are in a state of no magnetization. On the other hand, when the magnet fine particles have predetermined particle diameters or smaller, the magnet fine particles have a single-domain structure and become one magnet in which the magnet fine particles are magnetized in one direction. When such magnet fine particles are adsorbed to the magnet particles by magnetic force, the magnet fine particles can be adsorbed to the magnet particles uniformly. Thus, uneven adsorption or aggregation of the magnet particles and the magnet fine particles is prevented. In other words, an integral structure of the magnet particles having an appropriate spherical shape and the magnet fine particles can be obtained.

The integral configuration of the magnet particles and the magnet fine particles may include a case in which the magnet fine particles are aggregated into a cluster and a case in which the magnet fine particles are mixed in the insulating phase.

As an example of the method of integrating the magnet particles and the magnet fine particles, the magnet fine particles can simply be mixed with the magnet particles to obtain the desired configuration of the present invention that fulfills the above-described technical principle. However, it is more preferable to obtain the magnet fine particle by subjecting the magnet particles to surface grinding treatment as described above.

The surface grinding treatment is not particularly limited. However, ball milling or barrel grinding treatment is preferable because single-domain particles are easily obtained. It is more preferable to use ball milling because the grinding amount can be decreased and the particle diameters of the magnet fine particles can be decreased. In such a case, it is preferable to control the atmosphere during the treatment so that the newly-formed surfaces of the generated magnet fine particles and the magnet particles after surface grinding are not oxidized. In particular, grinding in vacuum or inert gas or wet grinding in a sufficiently dehydrated organic solvent is favorable.

The magnet fine particles, which are finer than the magnet particles and provided between the magnet particles and the insulating phase prepared in the process described below, have the following advantages. That is, the magnet fine particles enter the gaps of the magnet particles having a large number of sharp protrusions. Then, the magnet particles and the magnet fine particles are integrated to be formed into an approximately spherical shape. As a result, transmission of cracking can be prevented effectively when the insulating phase is formed and subjected to heat and pressure molding (including sintering) in the process described below. In other words, the integral structure of the magnet particles and the magnet fine particles effectively prevent damage of the insulating phase caused by the sharp protrusions, and prevent cracking of the magnet particles themselves.

Moreover, the integration process described above contributes to the improvement of the magnetic characteristics of the rare earth magnet molding. The reason thereof is presumed as follows. The chemical reaction between the raw material (insulation coating material) of the insulating phase and the magnet component is aggressively promoted between the insulating phase and the magnet component. At this time, the magnet fine particles are present to fill the gaps between the magnet particles and the insulating phase. Thus, the chemical reaction hardly proceeds to at least the interior portions of the magnet particles. This chemical reaction mainly occurs in a "reaction layer" that is composed of the magnet fine particles and the insulating phase and present in at least part of the region between the magnet particles and the insulating phase before the chemical reaction reaches the magnet particles. Therefore, the reaction layer inhibits penetration of the insulation covering material into the magnet particles, and plays a role in entirely preventing deterioration of the magnet particles caused by the insulation covering material. Accordingly, the excellent original magnet characteristics of the magnet particles can be maintained even after the consolidation process. In addition, it is presumed that transmission of cracking among the magnet particles can be further prevented effectively by inhibition of cracking of the insulating phase.

Subsequently, the surfaces of the magnet particles obtained by the pulverization are covered with the insulating phase in the present process. As a result, a magnet molding precursor is obtained.

Examples of the method of covering the magnet particles with the insulating material (for example, a rare earth oxide) to form the insulating phase include a vapor deposition method such as a physical vapor deposition (PVD) method and a chemical vapor deposition (CVD) method, and a method of oxidizing a rare earth complex applied to the magnet particles.

According to the vapor deposition method, while an ideal insulating phase containing a rare earth oxide with high purity can be formed, production costs may be increased. Therefore, the process of covering the integrated magnet particles and magnet fine particles with the insulating phase preferably includes a step of applying a solution containing a rare earth complex to the magnet particles or the particles obtained by integrating the magnet particles and the magnet fine particles, and a step of thermally decomposing and oxidizing the rare earth complex to obtain a rare earth oxide. Namely, the insulating phase having an even thickness can be obtained by the method including the two steps using the solution. Further, the magnet molding precursor including the insulating phase having excellent adhesiveness to the magnet particles and wettability to the oxide can be obtained.

The rare earth complex is not particularly limited as long as the rare earth complex contains a rare earth element and can cover the magnet particles and the magnet fine particles with the insulating phase. For example, the rare earth complex represented by $R^1L_3$ may be used. $R^1$ used herein represents a rare earth element. Specific examples of $R^1$ include yttrium (Y), dysprosium (Dy), scandium (Sc), lanthanum (La), cerium (Ce), praseodymium (Pr), neodymium (Nd), promethium (Pm), samarium (Sm), europium (Eu), gadolinium (Gd), terbium (Tb), holmium (Ho), erbium (Er), thulium (Tm), ytterbium (Yb), and lutetium (Lu). Among these, Nd, Dy, Tb, Pr or Ho is preferred.

Meanwhile, L is organic ligand, and represents an organic group of anion such as ion of $(CO(CO_3)CHCO(CH_3))$—, $(CO(C(CH_3)_3)CHCO(CCH_3))$—, $(CO(C(CH_3)_3)CHCO(C_3F_7))$— and $(CO(CF_3)CHCO(CF_3))$—, and β-diketonate ion. Note that "-" used in, for example, $(CO(CO_3)CHCO(CH_3))$— represents a bonding hand, which is also applied to the other compounds listed herein.

At the time of forming the insulating phase, alcohol such as methanol, ethanol, n-propanol and 2-propanol, acetone, ketone such as methylethylketone and diethyl ketone, or hexane may be used. Thus, $R^1L_3$ can be dissolved in one of these solvents having a low boiling point to be applied to the particles.

Note that the rare earth magnet is easily oxidized by water and as a result the magnet characteristics are impaired. Therefore, it is preferable to prevent water from being mixed into the magnet in such a manner that an anhydrous solvent is used for the solvent or the solvent is preliminarily subjected to dehydration treatment by zeolite or the like.

As for applying the solvent to the magnet particles and the magnet fine particles, for example, while the particles are arbitrarily poured in a container such as a beaker and stirred in a glove box in which the oxygen concentration and dew point are controlled, the rare earth complex solution is added dropwise to the container so that the particles are entirely drenched in the solution, followed by drying. The step of dropping and drying the solution may be repeated several times as necessary.

(Fourth Process)

In the present process, the magnet molding precursor obtained in the third process is heated under pressure. As a result, the rare earth magnet molding is finished.

The magnet molding precursor obtained in the third process may be processed into the rare earth magnet molding in a similar manner to the method in the heat and pressure molding of the surface-modified raw material magnetic powder described above. However, the magnet molding precursor includes the insulating phase that covers the magnet particles and the magnet fine particles. If the magnet molding precursor is only subjected to heating as in the case of a common sintered magnet, high densification due to mutual liquid phase sintering of the magnet particles and the magnet fine particles is not promoted. Therefore, application of pressure is essential.

With regard to the heat and pressure molding, discharge plasma sintering or hot pressing may be used. The magnet molding precursor is put in a metal mold and subjected to orientation treatment in a magnetic field, followed by heat and pressure molding at a high temperature of 550° C. or higher. It is preferable to perform the heat and pressure molding in a high-vacuum or inert gas atmosphere in order to prevent oxidation of the raw material or the molding die. The atmosphere is preferably in a high-vacuum state of 0.1 Pa or less.

The upper limit of the heating temperature depends on the component and type of the raw material magnetic powder as in the case of the heat and pressure molding for the surface-modified raw material magnetic powder. In general, when subjecting to heat and pressure molding, the raw material magnetic powder is preferably sintered at higher temperature because it is more difficult to densify the raw material magnetic powder than the surface-modified raw material magnetic powder because of the presence of the insulating phase. Note that the temperature is limited to 800° C. or lower with regard to the raw material magnetic powder of which the magnetic characteristics are significantly deteriorated because of a change in inside texture such as magnets obtained by the HDDR method and upset method. On the other hand, the raw material magnetic powder such as a sintered magnet, which does not realize magnetic characteristics when the heating temperature is too low and is generally heated up to 1200° C. without applied pressure, can be heated up to approximately 1200° C. However, it is necessary to use the molding die that has been subjected to protection treatment such as coating as in the case of the heat and pressure molding for the surface-modified raw material magnetic powder. In general, the raw material magnetic powder is preferably subjected to heat and pressure molding at 950° C. or lower.

The molding pressure is preferably 50 MPa or more, and it is preferable to apply the molding pressure as much as possible to the extent that the raw material magnetic powder is not burned into the molding die. In particular, the molding pressure is preferably 200 MPa or more, more preferably 400 MPa or more. Note that if the pressure is excessively high, the molding die is damaged. Thus, the upper limit of the pressure to be applied is inevitably limited depending on the shape and material of the molding die. The pressure to be applied may constantly be maintained during heating from the room temperature, or may be adjusted gradually in such a manner that the applied pressure is increased or decreased after reaching a predetermined temperature.

Generally, the reaction between the magnet particles and the insulating substance is suppressed more when the applied pressure is increased after reaching a high temperature. Accordingly, the raw material magnetic powder is more likely to have excellent magnetic characteristics (coercive force) and electrical resistivity. In addition, in the case of applying great pressure from the room temperature, the effect of promoting high densification can be exerted.

The rare earth magnet molding obtained by the heat and pressure molding is preferably subjected to heat treatment in order to improve the magnetic characteristics thereof. The heat treatment is preferably performed at least at 400 to 600° C. for 0.5 hours or more. Such heat treatment has the effects of removing residual strain and promoting recovery of inner defects. Depending on the raw material magnetic powder, the heat treatment having arbitrary plural steps including heat treatment at 600 to 800° C. for 10 minutes or more prior to the heat treatment at 400 to 600° C. may have significant effects.

[Motor]

Figure 4:
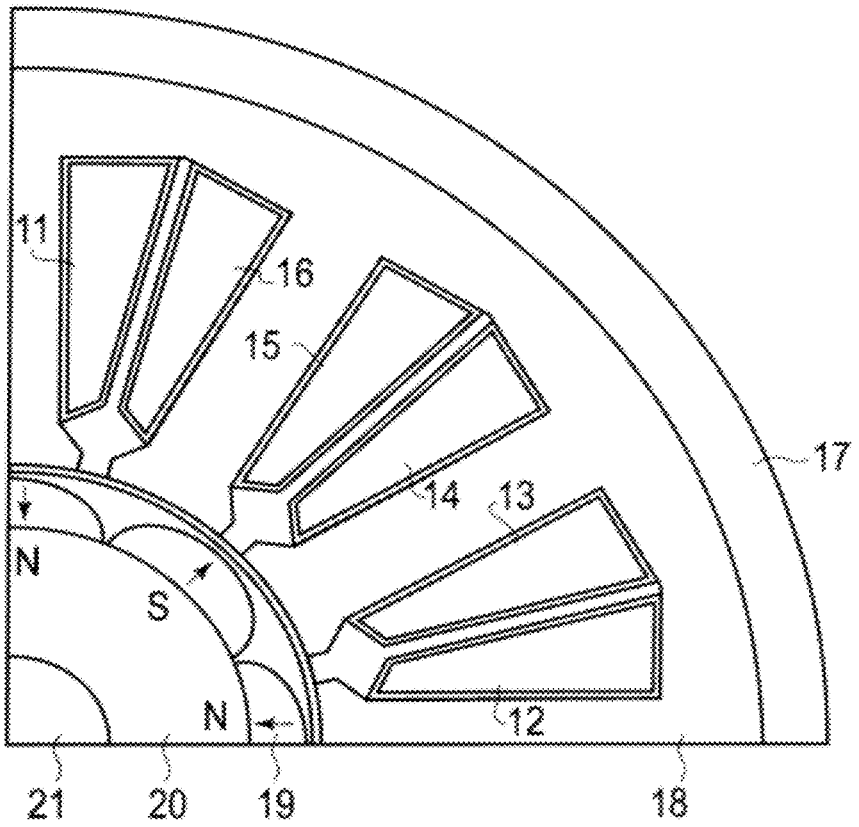
FIG. 4 is a one-quarter cross-sectional view of a surface magnet motor of a concentrated winding type, which adopts the rare earth magnet molding according to the embodiment of the present embodiment.

The following is a description of a motor according to the present embodiment. More specifically, the motor according to the present embodiment is a motor using the magnet molding described above or the magnet molding manufactured by the method as described above. For reference, FIG. 4 is a one-quarter cross-sectional view of a surface magnet motor of a concentrated winding type adopting the magnet molding. In FIG. 4, the respective reference numerals 11 and 12 denote a u-phase coil, the respective reference numerals 13 and 14 denote a v-phase coil, the respective reference numerals 15 and 16 denote a w-phase coil, the reference numeral 17 denotes an aluminum case, the reference numeral 18 denotes a stator, the reference numeral 19 denotes a magnet, the reference numeral 20 denotes a rotor iron core, and the reference numeral 21 denotes an axle. The magnet molding possesses high electric resistance and excellent magnetic characteristics such as coercive force. Therefore, it is easily possible to enhance continuous motor output by utilizing the motor manufactured by use of the magnet molding. The motor of the present embodiment is suitable for a middle-power or high-power motor. Moreover, since the motor using the magnet molding of the present embodiment possesses excellent magnetic characteristics such as coercive force, it is possible to downsize an end product. For example, if the motor is applied to a component for a vehicle, it is possible to improve fuel efficiency of the vehicle in association with weight reduction of the vehicle body. Furthermore, the motor of the present embodiment is also effective for a driving motor particularly used in an electric vehicle or a hybrid vehicle. It is possible to install the driving motor in a space which has been previously too small for such installation, whereby the motor of the present embodiment is anticipated to play a major role in versatility of electric vehicles and hybrid vehicles.

EXAMPLE

Hereinafter, the present invention will be described in conjunction with examples. It is to be noted that the scope of the present invention is not limited by the following examples.

Example 1

Powder of a Nd—Fe—B type anisotropic magnet prepared by means of an HDDR method was used as raw material magnetic powder. Specific procedures for preparation are as follows.

First, an ingot having a composition defined as "Nd: 12.6%, Co: 17.4%, B: 6.5%, Ga: 0.3%, Al: 0.5%, Zr: 0.1%, and Fe: balance (% by mass)" was prepared. The ingot was retained at 1120° C. for 20 hours for homogenization. The homogenized ingot was then heated from a room temperature up to 500° C. and retained at the same temperature in a hydrogen atmosphere, and then further heated up to 850° C. and retained at the same temperature.

Subsequently, the ingot was retained at 850° C. in vacuum, and then cooled down to obtain an alloy including a fine ferromagnetic phase recrystallization texture. The alloy was powdered under an argon atmosphere by means of a jaw crusher and a braun mill and thereby formed into rare earth magnet raw material magnetic powder having an average particle diameter of 300 μm. The particles having the particle diameters of smaller than 25 μm and the particles having the particle diameters of larger than 525 μm were removed by use of a sieve.

Subsequently, the surface of the raw material magnetic powder thus obtained was covered with a DyCoNd alloy as a target material by use of a vacuum sputtering device to obtain surface-modified raw material magnetic powder. The DyCoNd alloy used for covering was prepared as follows. That is, first, an ingot having a composition defined as 46.8% Nd-13.2% Dy-20.5% Co-0.5% B-0.3% Al-balance Fe (% by mass) was prepared. The ingot was retained at 1120° C. for 20 hours for homogenization. Then, the ingot was powdered under an argon atmosphere by means of a jaw crusher and a braun mill. The powder thus obtained was molded into a disk shape having a diameter of approximately 50 mm and a height of approximately 20 mm, and then sintered at 1050° C. under an argon atmosphere. Note that there is no problem with processing the alloy directly into a disk after homogenization.

For covering, the raw material magnetic power was placed in a cylindrical glass petri dish, and the glass petri dish was intermittently rotated to provide sputtered particles on the entire surface of the raw material magnetic powder from the target material. At the same time, a scrubber was provided in the glass petri dish to circulate the powder every time the petri dish was rotated and thereby stir the powder. Thus, the sputtering time was adjusted and accordingly the powder was covered with the alloy containing Dy, Co and Nd having a predetermined thickness to obtain the surface-modified raw material magnetic powder. In this example, 20 g of the raw material magnetic powder was placed in the petri dish and subjected to sputtering with argon gas for 150 minutes in total under a vacuum condition of $5\times10^{-5}$ Pa. The petri dish was intermittently rotated for 10 seconds per minute at a rate of 5 rpm. The surface of the obtained surface-modified raw material magnetic powder was analyzed with regard to an element distribution in a depth direction from the surface by means of AES. As a result, it was recognized that an alloy layer containing Dy, Co and Nd with approximately 0.5 μm was formed.

Subsequently, 20 g of the surface-modified raw material magnetic powder was filled in a metal mold having a press surface of 20 mm×20 mm, and then preformed while being subjected to magnetic field orientation at room temperature. The magnetic field for orientation was set to 1.6 MA/m and the molding pressure was set to 20 MPa.

Then, the preformed molding was subjected to heat and pressure molding under a vacuum condition of around $5\times10^{-5}$ Pa and thereby processed into a bulk magnet. The process of the heat and pressure molding is not particularly limited as long as heating and pressurization can be performed concurrently, and examples of the process include an electromagnetic process using a discharge plasma sintering device and a hydrostatic pressurization process such as HIP. In this example, a hot press was used for molding, and constant molding pressure (200 MPa) was maintained during elevation of temperature. At the same time, the molding temperature was maintained at 700° C. for one minute, and the preformed molding was then cooled. Thus, the preformed molding was processed into a rare earth magnet having a dimension of 20 mm×20 mm×approximately 5 mm. The vacuum condition was maintained during cooling to reach room temperature.

Subsequently, the rare earth magnet (bulk magnet) thus obtained was mechanically pulverized by a hammer, and the particles thereof were classified by a sieve to collect particles having particle diameters of 25 μm to 525 μm as magnet particles. The average particle diameter of the magnet particles thus obtained was approximately 350 μm. Thereafter, the surfaces of the obtained magnet particles were covered with the insulating phase as follows.

For the formation of the insulating phase on the surfaces of the magnet particles, first, dysprosium tri-isopropoxide (manufactured by Kojundo Chemical Laboratory Co., Ltd.), which is rare earth alkoxide, was applied. Subsequently, dysprosium tri-isopropoxide was subjected to heat treatment to be polycondensed, and a rare earth oxide was allowed to adhere to the surfaces of the magnet particles. Thus, the surfaces were covered with the insulating phase. The specific procedures from the formation of the insulating phase to the molding of the magnet are as follows.

(1) Dehydrated hexane as an organic solvent was added and dissolved in 20 g of dysprosium tri-isopropoxide, which is rare earth alkoxide, in a glove box filled with argon gas with a dew point of −80° C. or lower, and 100 mL of a dysprosium surface treating solution in total was prepared. The solution thus obtained is easily gelled by the reaction with water in the atmosphere. Therefore, in order to recognize the concentration of Dy in the solution, first, 2.5 mL of the solution was dried to extract residue. As a result of analyzing the concentration of Dy in the solution from the Dy content contained in the residue by means of ICP emission spectroscopic analysis, the concentration of Dy was 5.7 mg/mL.

(2) 85 mL of the dysprosium surface treating solution prepared above was added to 10 g of the magnet particles obtained above and then stirred in the glove box under the argon atmosphere. Subsequently, the solvent was removed, and the surfaces of the magnet particles were covered with rare earth alkoxide (dysprosium tri-isopropoxide).

(3) The magnet particles having the membranes obtained by the above operation were subjected to heat treatment at 350° C. for 30 minutes in vacuum. The magnet particles were further subjected to heat treatment at 600° C. for 60 minutes to thermally decompose the complex and thereby obtain a magnet molding precursor in which the magnet particles were covered with the insulating phase.

As a result of the SEM observation of the cross-section of the magnet molding precursor provided with the insulating phase, the maximum thickness of the insulating phase containing the rare earth oxide was approximately 4 μm. In addition, as a result of the measurement of the penetration depth of oxygen from the surface by means of AES analysis, the minimum depth was approximately 100 nm.

Subsequently, a metal mold having a press surface of 10 mm×10 mm was filled with 4 g of the magnet molding precursor obtained above, and the magnet molding precursor was then preformed while being subjected to magnetic field orientation at room temperature. The magnetic field for orientation was set to 1.6 MA/m and the molding pressure was set to 20 MPa.

Then, the preformed magnet molding precursor was subjected to heat and pressure molding under a vacuum condition of around $5\times10^{-5}$ Pa and thereby processed into a bulk magnet. The process of the heat and pressure molding is not particularly limited as long as heating and pressurization can be performed concurrently. In this example, a hot press was used for molding, and constant molding pressure (490 MPa) was maintained during elevation of temperature. At the same time, the molding temperature was maintained at 650° C. for three minutes, and the precursor was then cooled. Thus, the precursor was processed into a rare earth magnet molding having a dimension of 10 mm×10 mm×approximately 4 mm. The vacuum state was maintained during cooling to reach room temperature. Finally, the rare earth magnet molding thus obtained was subjected to heat treatment at 600° C. for one hour.

The magnetic characteristics (coercive force) (iHc) (unit: kA/m) and the electrical resistivity (unit: μΩn) of the rare earth magnet molding thus obtained were observed. The magnetic characteristics (coercive force) were observed by magnetizing a test piece in advance at a magnetizing field of 10 T by means of a pulse excitation type magnetizer MPM-15 made by Toei Industry, Co., Ltd., and measuring the test piece by means of a BH analyzer TRF-5AH-25 Auto made by Toei Industry, Co. Ltd. Meanwhile, the electrical resistivity was measured by a four-point probe method using a resistivity probe manufactured by NPS Inc. The material of the probe needles was tungsten carbide, the tip radius of each needle was 40 μm, the needle interval was 1 mm, and the total weight of the four needles was set to 400 g.

Figure 5:
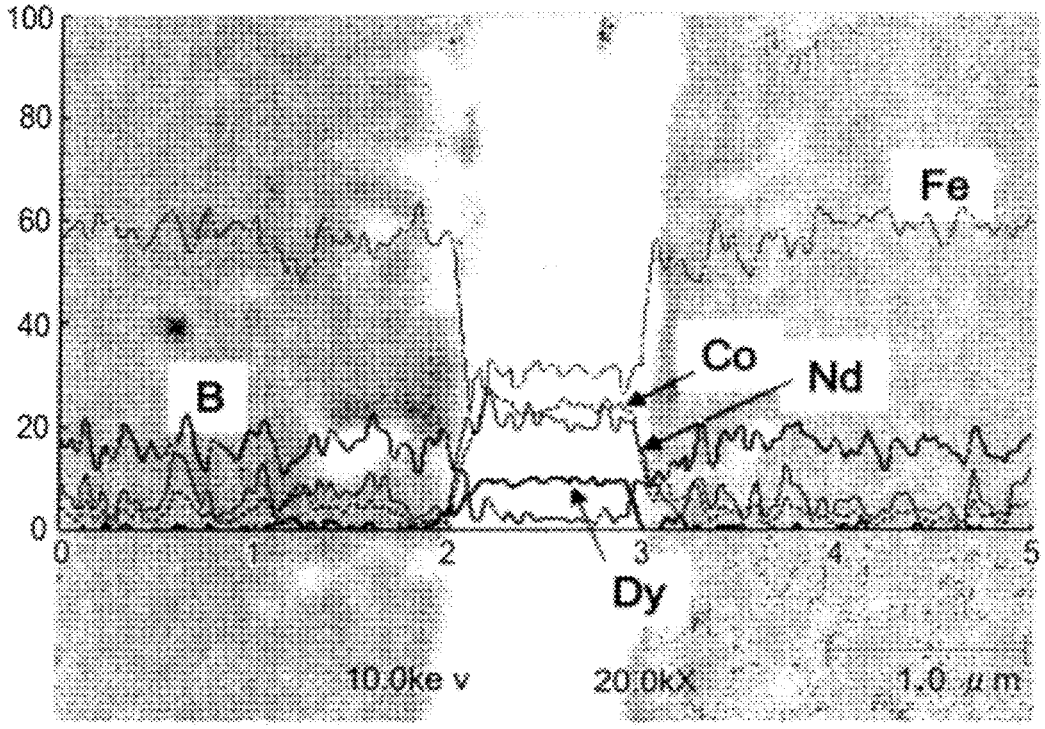
FIG. 5 is a view showing a result obtained by analyzing segregation regions by an AES method with regard to a magnet molding manufactured in Example 1.

The obtained magnet molding was observed with regard to the texture in the cross-section parallel to the orientation direction of the magnetic field. In addition, the segregation regions were subjected to linear analysis by means of EBSP (electron backscatter diffraction) analysis and WDX analysis to confirm the presence or absence of the segregation regions. The segregation regions used herein are not the regions with segregation having a fluctuation level of solid solution elements, but the regions with segregation showing a significant difference based on CPS in linear analysis such as an AES method and an EPMA method. The segregation regions confirmed by such a method can also be detected sufficiently in terms of contrast or color tone by means of observation with an optical microscope or SEM. FIG. 1 shows the result of the observation of the segregation regions present in the magnet particles, and FIG. 5 shows the result of the analysis of the segregation regions by an AES method. As shown in FIG. 5, with regard to the presence or absence of the segregation regions in this example, the segregation regions were determined to be present when there was a 3% or more difference in average concentration between the segregation regions and the interior portions of the magnet particles in terms of atom % based on CPS by an AES method. In this case, for the confirmation of the presence or absence of the segregation regions, arbitrary 100 or more magnet particles having short sides of 20 μm or longer were subjected to texture observation. If the magnet particles including the regions in which the segregation regions and the segregation elements were identified accounted for 30% or more of the total magnet particles, the magnet molding was determined to include the segregation regions.

Table 1 shows the evaluation result of these observations. The values of the magnetic characteristics (coercive force) and the electrical resistivity shown in Table 1 are relative values when the values in Comparative Example 1 or Comparative Example 4 described below are defined as 1.00.

Example 2

A rare earth magnet molding was obtained in the same manner as Example 1 except that praseodymium tri-isopropoxide was used instead of dysprosium tri-isopropoxide as rare earth alkoxide to form an insulating phase containing Pr oxide. The concentration of Pr in the praseodymium surface treating solution was analyzed by means of ICP. The coating amount of the solution was adjusted in such a manner that the amount was 40 mg in total with respect to 10 g of the magnet particles.

Example 3

A rare earth magnet molding was obtained in the same manner as Example 1 except that raw material magnetic powder for a sintered magnet was used instead of the raw material magnetic powder prepared by means of the HDDR method. The raw material magnetic powder was prepared as follows.

An alloy mixed to have a composition defined as Nd: 31.8, B: 0.97, Co: 0.92, Cu: 0.1, Al: 0.24, and balance: Fe (% by mass) was processed into an alloy ribbon having a thickness of 0.2 mm to 0.3 mm by means of a strip cast method. Subsequently, a container was filled with the alloy ribbon and placed in a hydrogen treating device. The hydrogen treating device was filled with a hydrogen gas atmosphere with pressure of 500 kPa so that hydrogen was adsorbed to the alloy ribbon at room temperature. Then, the atmosphere was converted into argon gas, and the pressure was decreased to $10^{-5}$ Pa to release hydrogen. Through such hydrogen treatment, the alloy ribbon was processed into amorphous powder having a size of approximately 0.15 mm to 0.2 mm.

0.05% by mass of zinc stearate was added and mixed, as a pulverization auxiliary agent, to 100% by mass of the coarse pulverized powder prepared by the above-described hydrogen treatment, and then subjected to a pulverizing process by a jet mill apparatus to prepare fine powder having an average particle diameter of approximately 3 μm.

The fine powder thus obtained was molded by a pressing device to prepare a powder molding. More specifically, the fine powder was compressed while being subjected to magnetic field orientation in a pressurized magnetic field, and then subjected to press molding. The magnetic field for orientation was set to 1.6 MA/m and the molding pressure was set to 20 MPa. Subsequently, the molding was removed from the pressing device, and then sintered in a vacuum furnace at 1020° C. for four hours to prepare a bulk magnet of a sintered body.

The bulk magnet thus obtained was mechanically pulverized by a hammer, and the particles thereof were classified by a sieve to collect particles having particle diameters of 25 μm to 355 μm as raw material magnetic powder. The average particle diameter of the raw material magnetic powder thus obtained was approximately 230 μm.

In this example, the condition of the heat and pressure molding for the magnet molding precursor was changed along with the change of the raw material magnetic powder. In particular, the molding pressure was set to 200 MPa and the molding temperature was set to 720° C.

In this example, the AES analysis of the surface-modified raw material magnetic powder was omitted. However, it was determined that the alloy layer containing Dy, Co and Nd having approximately the same thickness as in the case of Example 1 was formed according to the external appearance of the particle diameter of the raw material magnetic powder and the weight change of the powder before and after sputtering.

The process of covering the obtained magnet particles with the insulating phase and preparing the magnet molding precursor was the same as in the case of Example 1. However, with regard to the condition of the heat and pressure molding during hot pressing, constant molding pressure (490 MPa) was maintained during elevation of temperature, and the molding temperature was maintained at 870° C. for three minutes. Then, the precursor was cooled. Thus, the precursor was processed into a rare earth magnet molding having a dimension of 10 mm×10 mm×approximately 4 mm. The vacuum state was maintained during cooling to reach room temperature. At the time of heating at 750° C. or higher, a carbon sheet was used as a mold release agent in order to prevent fusion bonding between the metal mold and the magnet molding. Finally, the rare earth magnet molding thus obtained was subjected to heat treatment at 600° C. for two hours and further at 800° C. for one hour.

Example 4

A rare earth magnet molding was obtained in the same manner as Example 3 except that, when the surface-modified raw material magnetic powder was obtained, hydride powder of a DyCo alloy was mixed with the raw material magnetic powder and then subjected to melting, instead of the sputtering process of the alloy.

More specifically, when the raw material magnetic powder was processed into the surface-modified raw material magnetic powder, the raw material magnetic powder was mixed with the fine particles of the DyCo alloy (hydride) and heated in vacuum, so that the DyCo alloy was melted along with a decrease in melting point due to dehydrogenation to be allowed to adhere to the surface of the raw material magnetic powder. The fine powder of the DyCo alloy was prepared in such a manner that an alloy having a composition of 35% Dy-65% Co (% by mass) was melted, and then coarsely pulverized by use of the change in volume by hydrogen absorption and further pulverized by a ball mill. The fine powder of the DyCo hydride thus obtained was mixed with the raw material magnetic powder in the proportion of 1:9 (mass ratio), and then heated at approximately 740° C. under a vacuum condition to obtain the surface-modified raw material magnetic powder.

Example 5

A rare earth magnet molding was obtained in the same manner as Example 3 except that Dy pure metal having a diameter of 100 mm and a height of 5 mm was used as a target material for sputtering.

Example 6

A rare earth magnet molding was obtained in the same manner as Example 1 except that, when the surface-modified raw material magnetic powder was obtained, hydride powder of a DyCo alloy was mixed with the raw material magnetic powder and then subjected to melting, instead of the sputtering process of the alloy. The specific method of obtaining the surface-modified raw material magnetic powder is the same as in the case of Example 4 described above.

Example 7

A rare earth magnet molding was obtained in the same manner as Example 6 except that the surfaces of the magnet particles were covered with the insulating phase by means of vacuum vapor deposition. The specific method of covering with the insulating phase of this example is as follows.

15 g of the obtained magnet particles (the particles having the particle diameters of 25 μm to 525 μm, an average particle diameter: approximately 350 μm) was placed in a glass petri dish. Subsequently, the magnet particles were stirred by a glass stirrer. At the same time, the surfaces of the magnet particles were covered with a Dy membrane having a thickness of 50 nm as the insulating phase by means of vacuum arc discharge under a vacuum condition of $10^{-4}$ Pa order by using a plasma generating apparatus including Dy metal (purity: 99.9%, diameter (Ø): 8 mm) as a cathode. Here, a test for preliminarily forming a membrane on a silicon substrate was performed by the apparatus used above, and the relation between the frequency of discharge and the film thickness was observed so that the frequency of discharge by which a desired film thickness was obtained was determined.

Subsequently, oxygen was introduced into the apparatus and the degree of vacuum was changed to $10^{-2}$ Pa order. Then, a $Dy_2O_3$ membrane having a thickness of 200 nm was further formed on the Dy membrane formed above. The crystal structure of the formed membrane was confirmed to be in an amorphous state according to X-ray analysis.

The powder provided with the $Dy_2O_3$ membrane was heated at 500° C. for 15 minutes in a state of circulation of 20 cc/min of argon. Thus, a magnet molding precursor having crystallized $Dy_2O_3$ on the outermost portion thereof was obtained. The obtained covering powder was analyzed up to 700° C. by means of DSC (differential scanning calorimetry). However, no particular melting phenomenon was confirmed other than crystallization of the film forming substance.

Here, electrical resistivity was measured by a four-point probe method using a sample provided with $Dy_2O_3$ described above preliminarily formed on a Si substrate. In this case, since electrical resistivity could not be measured because of exceeding the upper limit of the measuring range, the membrane was confirmed to have a sufficiently high insulation property.

Example 8

A rare earth magnet molding was obtained in the same manner as Example 1 except that a Dy—Tb—Pr—Co alloy was used as a target material for sputtering.

The alloy was obtained by vacuum arc melting of 100 g of commercially-available powder including 10 g of Pr powder, 30 g of Dy powder, 10 g of Tb powder and 50 g of Co powder to prepare a metal button. The alloy thus obtained was subjected to hydrogen absorption treatment and coarsely pulverized to obtain hydride powder. The obtained powder was further pulverized by use of a hammer and a ball mill, and then processed into a target material formed into a disk shape of Ø 50 mm by hot press sintering. Here, hydrogen absorption is only required to be capable of cracking development and coarse pulverization due to the change in volume, and hot pressing can be carried out under an arbitrary condition if bulking is possible. The composition of the target material includes Co in order to prevent oxidation of Pr and Tb. However, an arbitrary choice of the composition may be made according to the intended segregation element and concentration.

Example 9

A rare earth magnet molding was obtained in the same manner as Example 6 except that yttrium tri-isopropoxide was used instead of dysprosium tri-isopropoxide as rare earth alkoxide to form an insulating phase containing Y oxide.

Example 10

A rare earth magnet molding was obtained in the same manner as Example 1 except that the Dy pure metal used in Example 5 was used as a target material for sputtering, and the magnet particles were covered with the insulating phase in the same manner as Example 9.

Example 11

A rare earth magnet molding was obtained in the same manner as Example 7 except that a 30% Tb-15% Pr-10% Ho-balance Co alloy was used instead of Dy metal as a cathode. The alloy was prepared in such a manner that an alloy of Tb, Pr, Ho and Co was prepared by vacuum arc melting as a master alloy, and then subjected to concentration analysis by ICP. Then, the master alloy was mixed to have a predetermined concentration, and melted by means of high-frequency vacuum melting. The obtained casting alloy was processed into an electrode of Ø 8 mm by mechanical processing.

Example 12

A rare earth magnet molding was obtained in the same manner as Example 6 except that the magnet particles were covered with the insulating phase to be processed into the magnet molding precursor while the magnet particles were subjected to barrel grinding by using a ball mill. The specific method of barrel grinding is as follows.

First, the obtained magnet particles were classified by using a sieve. 30 g of the magnet particles having the particle diameters of 100 μm or more to less than 525 μm and 55 g of a grinding stone (No. SC-4, manufactured by Tipton Corp.) were put into a pot made by SUS having an inner diameter of 55 mm and a height of 60 mm in a glove box in a state of circulation of argon having a dew point of −80° C. 30 mL of hexane was added to the pot to entirely impregnate the inserted materials therewith. Subsequently, the pot was covered with a lid to be subjected to agitation at a rate of 300 revolutions for two hours by a planetary ball mill (manufactured by Retsch Co., Ltd.). Thus, the magnet particles were subjected to surface grinding.

After the completion of grinding, the container was placed in the glove box and opened, and then dried but not exposed to the atmosphere. The magnet fine particles generated during grinding were particularly fine, and immediately adsorbed to the magnet particles. Thus, a mixture of the approximately spherical magnet particles and magnet fine particles was obtained.

FIG. 3 is an enlarged photograph of the magnet fine particles and the insulating phase of this example. In this example, arbitrary 150 or more magnet particles having short sides of 20 μm or longer were subjected to texture observation at 200-fold magnification. As a result, the mixed regions in which the boundaries between the magnet fine particles and the insulating phase located among the magnet particles were not clearly distinguishable accounted for approximately 40% of all boundaries.

Example 13

A rare earth magnet molding was obtained in the same manner as Example 7 except that the magnet particles were subjected to barrel grinding in the same manner as Example 12 prior to covering the magnet particles with the insulating phase and processing into the magnet molding precursor.

Example 14

A rare earth magnet molding was obtained in the same manner as Example 1 except that the magnet particles were subjected to barrel grinding in the same manner as Example 12 prior to covering the magnet particles with the insulating phase and processing into the magnet molding precursor.

Example 15

A rare earth magnet molding was obtained in the same manner as Example 5 except that the magnet particles were subjected to barrel grinding in the same manner as Example 12 prior to covering the magnet particles with the insulating phase and processing into the magnet molding precursor.

Example 16

A rare earth magnet molding was obtained in the same manner as Example 3 except that the magnet particles were subjected to barrel grinding in the same manner as Example 12 prior to covering the magnet particles with the insulating phase and processing into the magnet molding precursor.

Example 17

A rare earth magnet molding was obtained in the same manner as Example 1 except that mixed powder of two types of raw material magnetic powder having different Dy concentrations was bulked, and the pulverized powder was used for the magnet particles.

More specifically, an ingot having a composition defined as "Nd: 12.6%, Co: 17.4%, B: 6.5%, Ga: 0.3%, Al: 0.5%, Zr: 0.1%, and Fe: balance" was prepared, and processed into the raw material magnetic powder in the same manner as Example 1.

Similarly, an ingot having a composition defined as "Nd: 12.0%, Dy: 8.5%, Co: 17.4%, B: 6.5%, Ga: 0.3%, Al: 0.5%, Zr: 0.1%, and Fe: balance" was prepared, and processed into the raw material magnetic powder in the same manner as described above.

The two types of the raw material magnetic powder thus obtained were mixed in the proportion of 1:1 in terms of a weight ratio, and used for the magnet particles in this example.

Comparative Example 1

A rare earth magnet molding was obtained in the same manner as Example 1 except that surface modification by applying the DyCoNd alloy to the raw material magnetic powder and application of the insulating phase to the magnet particles were not carried out.

Comparative Example 2

Figure 6:
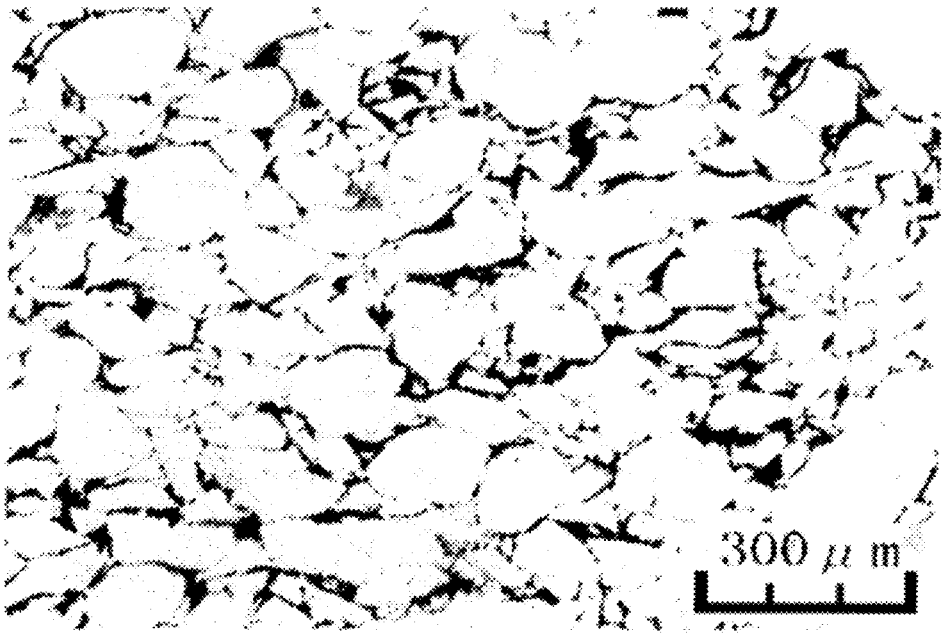
FIG. 6 is a photograph in which no segregation region is confirmed with regard to a magnet molding manufactured in Comparative Example 2.

A rare earth magnet molding was obtained in the same manner as Example 1 except that surface modification by applying the DyCoNd alloy to the raw material magnetic powder was not carried out. The result of the texture observation of the rare earth magnet molding obtained in this example is shown in FIG. 6 as an example in which no segregation region is recognized.

Comparative Example 3

A rare earth magnet molding was obtained in the same manner as Example 6 except that surface modification of the raw material magnetic powder by using the DyCo alloy hydride was not carried out.

Comparative Example 4

A rare earth magnet molding was obtained in the same manner as Example 4 except that surface modification of the raw material magnetic powder by using the DyCo alloy hydride and application of the insulating phase to the magnet particles were not carried out.

Comparative Example 5

A rare earth magnet molding was obtained in the same manner as Example 4 except that surface modification of the raw material magnetic powder by using the DyCo alloy hydride was not carried out.

Comparative Example 6

A rare earth magnet molding was obtained in the same manner as Example 12 except that surface modification of the raw material magnetic powder by using the DyCo alloy hydride was not carried out.

Comparative Example 7

A rare earth magnet molding was obtained in the same manner as Example 16 except that surface modification of the raw material magnetic powder by application of the DyCoNd alloy was not carried out.

TABLE 1

| | Raw Material Magnetic Powder | Segregation Element | Segregation Region | Mixed Region of Magnetic Fine Particles and Insulating Phase (%) | Electrical Resistivity (Relative Value) | Coercive Force (Relative Value) | Relative Comparison Material |
|---|---|---|---|---|---|---|---|
| Example 1 | HDDR | DyCoNd | Present | <5 | 4.50 | 1.63 | Comparative Example 1 |
| Example 2 | HDDR | DyCoNd | Present | <5 | 4.70 | 1.64 | Comparative Example 1 |
| Example 3 | Sintering | DyCoNd | Present | <5 | 3.60 | 1.50 | Comparative Example 4 |
| Example 4 | Sintering | DyCo | Present | <5 | 3.40 | 1.41 | Comparative Example 4 |
| Example 5 | Sintering | Dy | Present | <5 | 3.10 | 1.37 | Comparative Example 4 |
| Example 6 | HDDR | DyCo | Present | <5 | 4.10 | 1.51 | Comparative Example 1 |
| Example 7 | HDDR | DyCo | Present | <5 | 4.30 | 1.54 | Comparative Example 1 |
| Example 8 | HDDR | DyTbPrCo | Present | <5 | 4.30 | 1.62 | Comparative Example 1 |
| Example 9 | HDDR | DyCo | Present | <5 | 4.10 | 1.47 | Comparative Example 1 |
| Example 10 | HDDR | Dy | Present | <5 | 3.80 | 1.36 | Comparative Example 1 |
| Example 11 | HDDR | DyCo | Present | <5 | 4.20 | 1.50 | Comparative Example 1 |
| Example 12 | HDDR | DyCo | Present | 40 | 7.10 | 1.36 | Comparative Example 1 |
| Example 13 | HDDR | DyCo | Present | 45 | 7.10 | 1.21 | Comparative Example 1 |
| Example 14 | HDDR | DyCoNd | Present | 75 | 7.50 | 1.42 | Comparative Example 1 |
| Example 15 | Sintering | Dy | Present | 55 | 6.10 | 1.28 | Comparative Example 4 |
| Example 16 | Sintering | DyCoNd | Present | 80 | 7.40 | 1.31 | Comparative Example 4 |
| Example 17 | HDDR | Dy | Present | <5 | 3.30 | 1.30 | Comparative Example 1 |
| Comparative Example 1 | HDDR | None | None | — | 1.00 | 1.00 | — |
| Comparative Example 2 | HDDR | None | None | <5 | 4.00 | 1.15 | Comparative Example 1 |
| Comparative Example 3 | HDDR | None | None | <5 | 3.80 | 1.11 | Comparative Example 1 |
| Comparative Example 4 | Sintering | None | None | — | 1.00 | 1.00 | — |
| Comparative Example 5 | Sintering | None | None | <5 | 3.20 | 1.09 | Comparative Example 4 |
| Comparative Example 6 | HDDR | None | None | 55 | 6.80 | 1.08 | Comparative Example 1 |
| Comparative Example 7 | Sintering | None | None | 35 | 5.90 | 1.12 | Comparative Example 4 |

As shown in the result indicated in Table 1, it is recognized that when predetermined segregation regions are present in the magnet particles, both high magnetic characteristics (coercive force) and high electrical resistivity are obtainable, and a rare earth magnet molding with low heat generation can be obtained. In addition, when the regions in which the magnet fine particles and the insulating phase are mixed among the magnet particles are present, a magnet molding with much higher electrical resistivity and lower heat generation can be obtained.

According to the comparison of Examples 3 to 5 with Examples 6 to 10, the rare earth magnetic powder having more excellent electrical resistivity can be obtained when the HDDR magnetic powder is used as the raw material magnetic powder.

In addition, according to the comparison of Examples 1 and 2 and Examples 6 to 11, it is recognized that the magnet molding having more excellent electrical resistivity can be obtained when the insulating phase containing Nd, Dy, Tb, Pr or Ho is used compared with the insulating phase containing other rare earth elements.

As is clear from the result described above, according to the present invention, a rare earth magnet molding having high magnetic characteristics (coercive force) with low heat generation can be obtained, and a downsized and high-performance motor for an electrical vehicle can be provided.

The entire content of Japanese Patent Application No. P2009-208621 (filed on Sep. 9, 2009) is herein incorporated by reference.

Although the present invention has been described above by reference to the embodiment and examples, the present invention is not limited to those, and it will be apparent to these skilled in the art that various modifications and improvements can be made within the scope of the present invention.

INDUSTRIAL APPLICABILITY

According to the present invention, the regions in which an element having a large anisotropic magnetic coefficient is segregated are discretely distributed in the magnet particles. Accordingly, the present invention can provide the magnet molding that has excellent resistance to heat in motor environments or the like while maintaining high magnetic characteristics (coercive force).

The invention claimed is:

1. A rare earth magnet molding, comprising:

rare earth magnet particles having particle diameters in a range of 25 μm to 525 μm, an insulating phase containing a rare earth oxide present among the rare earth magnet particles, a content of the rare earth oxide in the insulating phase is 80% by volume or more, and magnet fine particles having particle diameters less than 25 μm, wherein an aggregation region in which the magnet fine particles are aggregated is present in at least part of circumferences of the rare earth magnet particles, wherein segregation regions in which at least one element selected from the group consisting of Dy, Tb, Pr and Ho is segregated are distributed from a surface of the rare earth magnet particles to a center of the rare earth magnet particles, wherein a content of the magnet fine particles is 40% by volume or less with respect to a content of the rare earth magnet particles, wherein a material of the magnet fine particles is the same as a material of the rare earth magnet particles, and wherein surfaces of the rare earth magnet particles contact the insulating phase.

2. The rare earth magnet molding according to claim 1, wherein a region in which the magnet fine particles are mixed with the insulating phase is present.

3. The rare earth magnet molding according to claim 1, wherein each segregation region further contains Co.

4. The rare earth magnet molding according to claim 3, wherein each segregation region further contains Nd.

5. The rare earth magnet molding according to claim 1, wherein the rare earth magnet particles are prepared by processing raw material magnetic powder produced by a hydrogenation decomposition desorption recombination method.

6. The rare earth magnet molding according to claim 1, wherein the rare earth oxide comprises an oxide of at least one element selected from the group consisting of Nd, Dy, Tb, Pr and Ho.

7. The rare earth magnet molding according to claim 6, wherein the rare earth oxide comprises an oxide of at least one element selected from the group consisting of Dy, Tb and Pr.

8. The rare earth magnet molding according to claim 6, wherein the rare earth oxide comprises an oxide of at least one element selected from the group consisting of Tb and Pr.

9. A motor comprising: the rare earth magnet molding according to claim 1.

10. A method for manufacturing the rare earth magnet molding according to claim 1, the method comprising:

covering a surface of raw material magnetic powder with a single substance of at least one element selected from the group consisting of Dy, Tb, Pr and Ho or an alloy thereof to obtain surface-modified raw material magnetic powder;

subjecting the obtained surface-modified raw material magnetic powder to pressure molding under a heating atmosphere while subjecting to magnetic orientation in a magnetic field to obtain an anisotropic rare earth magnet;

contacting surfaces of rare earth magnet particles obtained by pulverizing the obtained anisotropic rare earth magnet with the insulating phase to obtain a magnet molding precursor; and heating the obtained magnet molding precursor under pressure.

11. The method for manufacturing a rare earth magnet molding according to claim 10, further comprising:

mixing and integrating the rare earth magnet particles obtained by pulverizing the obtained anisotropic rare earth magnet with magnet fine particles, wherein surfaces of the integrated rare earth magnet particles are covered with the insulating phase.

12. A method for manufacturing the rare earth magnet molding according to claim 1, the method comprising:

subjecting mixed magnetic powder of first raw material magnetic powder and second raw material magnetic powder to pressure molding under a heating atmosphere while subjecting to magnetic orientation in a magnetic field to obtain an anisotropic rare earth magnet, the second raw material magnetic powder being obtained by substituting at least one element selected from the group consisting of Dy, Tb, Pr, and Ho for a part of an element of the first raw material magnetic powder;

contacting surfaces of rare earth magnet particles obtained by pulverizing the obtained anisotropic rare earth magnet with the insulating phase to obtain a magnet molding precursor; and heating the obtained magnet molding precursor under pressure.

13. The method for manufacturing a rare earth magnet molding according to claim 12, further comprising:

mixing and integrating the rare earth magnet particles obtained by pulverizing the obtained anisotropic rare earth magnet with magnet fine particles, wherein surfaces of the integrated rare earth magnet particles are covered with the insulating phase.

14. The rare earth magnet molding according to claim 1, wherein the segregation regions are distributed continuously from the surface of the rare earth magnet particles to the center of the rare earth magnet particles.

15. The rare earth magnet molding according to claim 1, wherein the rare earth oxide is dysprosium oxide.

16. The rare earth magnet molding according to claim 1, wherein surfaces of the rare earth magnet particles are completely covered with the insulating phase.

17. The rare earth magnet molding according to claim 1, wherein the magnet fine particles aggregated in the aggregation region are mixed with the insulating phase.

18. The rare earth magnet molding according to claim 1, wherein an average particle diameter of the magnet fine particles is 1/10 or less with respect to an average particle diameter of the rare earth magnet particles.

19. The rare earth magnet molding according to claim 1, wherein a DyCoNd alloy is segregated in the segregation regions.

20. The rare earth magnet molding according to claim 1, wherein a DyCo alloy is segregated in the segregation regions.

21. The rare earth magnet molding according to claim 1, wherein surfaces of the rare earth magnet particles are covered with the insulating phase.

22. A rare earth magnet molding, comprising:

rare earth magnet particles having particle diameters in a range of 25 μm to 525 μm, an insulating phase containing a rare earth oxide present among the rare earth magnet particles, a content of the rare earth oxide in the insulating phase is 80% by volume or more, and magnet fine particles having particle diameters less than 25 μm, wherein an aggregation region in which the magnet fine particles are aggregated is present in at least part of circumferences of the rare earth magnet particles, wherein segregation regions in which at least one element selected from the group consisting of Dy, Tb, Pr and Ho is segregated are distributed from a surface of the rare earth magnet particles to a center of the rare earth magnet particles, wherein a content of the magnet fine particles is 40% by volume or less with respect to a content of the rare earth magnet particles, wherein a material of the magnet fine particles is the same as a material of the rare earth magnet particles, wherein surfaces of the rare earth magnet particles are covered with the insulating phase, and wherein an average particle diameter of the magnet fine particles is 1/10 or less with respect to an average particle diameter of the rare earth magnet particles.

* * * * *